US010248075B2

(12) United States Patent
Itabashi

(10) Patent No.: US 10,248,075 B2
(45) Date of Patent: Apr. 2, 2019

(54) IMAGE FORMING APPARATUS INCLUDING DEVELOPING CARTRIDGE HAVING ELECTRICAL CONTACT SURFACE

(71) Applicant: BROTHER KOGYO KABUSHIKI KAISHA, Nagoya-shi, Aichi-ken (JP)

(72) Inventor: Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/797,518

(22) Filed: Oct. 30, 2017

(65) Prior Publication Data

US 2018/0181055 A1 Jun. 28, 2018

(30) Foreign Application Priority Data

Dec. 27, 2016 (JP) ..... 2016-253634

(51) Int. Cl.
*G03G 15/00* (2006.01)
*G03G 21/16* (2006.01)

(52) U.S. Cl.
CPC ..... *G03G 21/1652* (2013.01); *G03G 21/1676* (2013.01)

(58) Field of Classification Search
CPC ..... G03G 15/80; G03G 15/0865; G03G 15/0863; G03G 21/1652; G03G 21/1647
USPC ..... 399/90
See application file for complete search history.

(56) References Cited

U.S. PATENT DOCUMENTS

2003/0215261 A1* 11/2003 Karakama ..... G03G 21/1871 399/111
2012/0214356 A1* 8/2012 Hasegawa ..... G01R 1/0483 439/817
2012/0274992 A1* 11/2012 Suzuki ..... G03G 21/1657 358/474
2016/0254629 A1* 9/2016 Athreya ..... H01L 23/49827 439/660
2018/0181058 A1* 6/2018 Yokoi ..... G03G 15/0863

FOREIGN PATENT DOCUMENTS

JP 2008-242085 A 10/2008

* cited by examiner

*Primary Examiner* — Walter L Lindsay, Jr.
*Assistant Examiner* — Frederick Wenderoth
(74) *Attorney, Agent, or Firm* — Merchant & Gould P.C.

(57) ABSTRACT

An image forming apparatus includes: a frame; a plate including first and second electrical contact portions; and a developing cartridge detachably mountable to the frame. At least a portion of the first electrical contact portion is movable relative to the plate and separated farther from the plate than the second electrical contact portion The developing cartridge includes: a storage medium and a pressing portion. The storage medium includes first and second electrical contact surfaces. The pressing portion is configured to press the first electrical contact surface toward the first electrical contact portion to bring the first electrical contact surface into contact with the first electrical contact portion and to press the second electrical contact surface toward the second electrical contact portion to bring the second electrical contact surface into contact with the second electrical contact portion in a state where the developing cartridge is mounted to the frame.

9 Claims, 12 Drawing Sheets

IMAGE FORMING APPARATUS INCLUDING DEVELOPING CARTRIDGE HAVING ELECTRICAL CONTACT SURFACE

CROSS REFERENCE TO RELATED APPLICATION

This application claims priority from Japanese Patent Application No. 2016-253634 filed Dec. 27, 2016. The entire content of the priority application is incorporated herein by reference.

TECHNICAL FIELD

The present disclosure relates to an image forming apparatus.

BACKGROUND

Electrophotographic image forming apparatus, such as laser printers and LED printers, are well known in the art. In one such image forming apparatus, a developing cartridge that accommodates toner is detachably mounted to an apparatus body of the image forming apparatus. As the developing cartridge is mounted to the apparatus body, a developing roller of the developing cartridge contacts a photosensitive drum of the apparatus body, making image formation possible.

One such image forming apparatus includes the developing cartridge with a storage element for storing information about the developing cartridge, such as the number of pages that the developing cartridge is capable of printing. The storage element may be an integrated circuit (chip), for example. In this image forming apparatus, the storage element is connected to cartridge-side contacts of the developing cartridge. When the developing cartridge is mounted to the apparatus body of the image forming apparatus, the cartridge-side contacts come into contact with body-side contacts of the image forming apparatus, enabling the image forming apparatus to read information related to the developing cartridge from the storage element.

SUMMARY

When a developing cartridge including a storage element is mounted to the apparatus body of the image forming apparatus, a spring pressing the cartridge-side contacts becomes compressed. Consequently, after the developing cartridge is mounted to the apparatus body, a restoring force of the spring presses the cartridge-side contacts against the body-side contacts. With this configuration, it may be necessary to adjust an amount of force with which the body-side contacts apply pressure and an amount of force with which the cartridge-side contacts apply pressure.

In view of the foregoing, it is an object of the disclosure to provide an image forming apparatus capable of allowing adjustment in a force of pressure applied by body-side contacts and a force of pressure applied by cartridge-side contacts.

In order to attain the above and other objects, according to one aspect, the disclosure provides an image forming apparatus including: a frame; a plate; and a developing cartridge. The plate includes a first electrical contact portion and a second electrical contact portion. At least a portion of the first electrical contact portion is movable relative to the plate. The at least a portion of the first electrical contact portion is separated farther from the plate than the second electrical contact portion is from the plate. The developing cartridge is detachably mountable to the frame. The developing cartridge includes: a storage medium and a pressing portion. The storage medium includes a first electrical contact surface and a second electrical contact surface. The pressing portion is configured to press the first electrical contact surface toward the first electrical contact portion to bring the first electrical contact surface into contact with the first electrical contact portion and to press the second electrical contact surface toward the second electrical contact portion to bring the second electrical contact surface into contact with the second electrical contact portion in a state where the developing cartridge is mounted to the frame.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
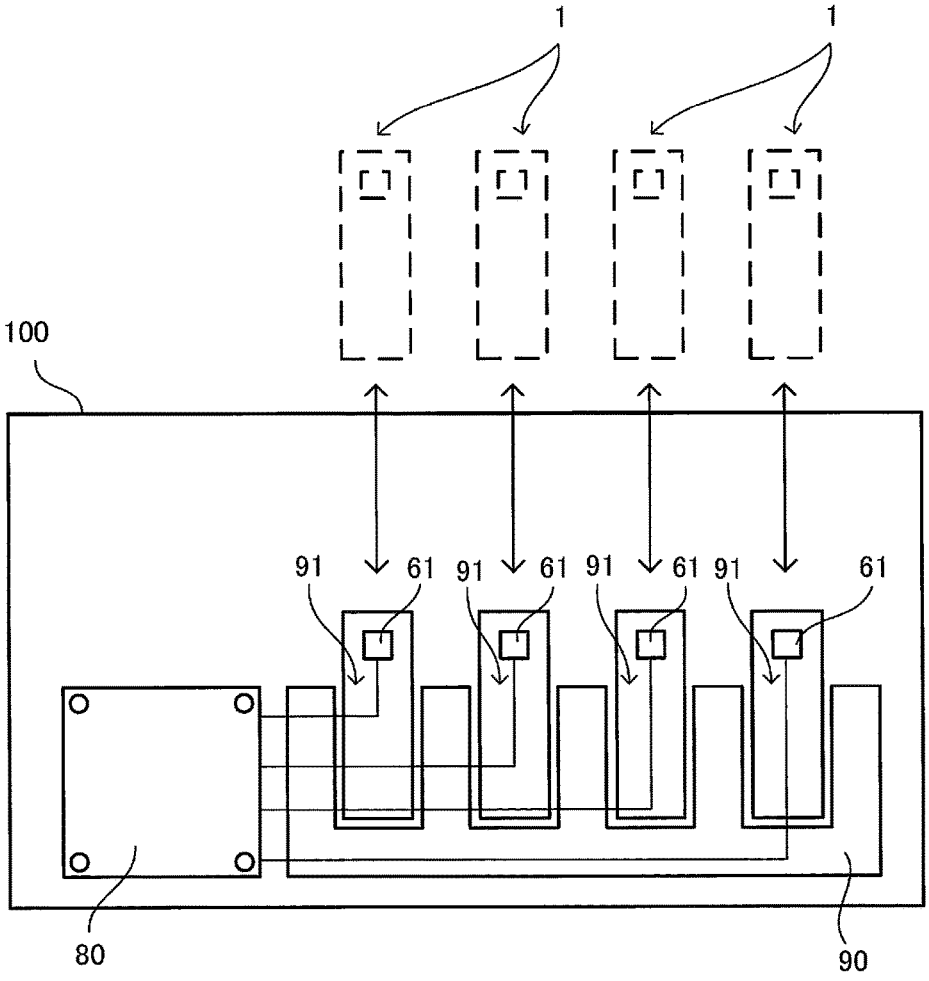
FIG. 1 is a schematic view of an image forming apparatus according to one embodiment.

An image forming apparatus 100 according to one embodiment will be described with reference to the accompanying drawings, wherein like parts and components are designated by the same reference numerals to avoid duplicating description.

1. Structure of Image Forming Apparatus

FIG. 1 is a schematic view of the image forming apparatus 100. The image forming apparatus 100 is an electrophotographic printer. For example, the image forming apparatus 100 may be a laser printer or an LED printer. The image forming apparatus 100 includes four developing cartridges 1, and a drawer unit 90. The drawer unit 90 is a frame in which the four developing cartridges 1 can be mounted. The image forming apparatus 100 is configured to form an image on a recording surface of printing paper with developer (toner, for example) supplied from the four developing cartridges 1.

Figure 2:
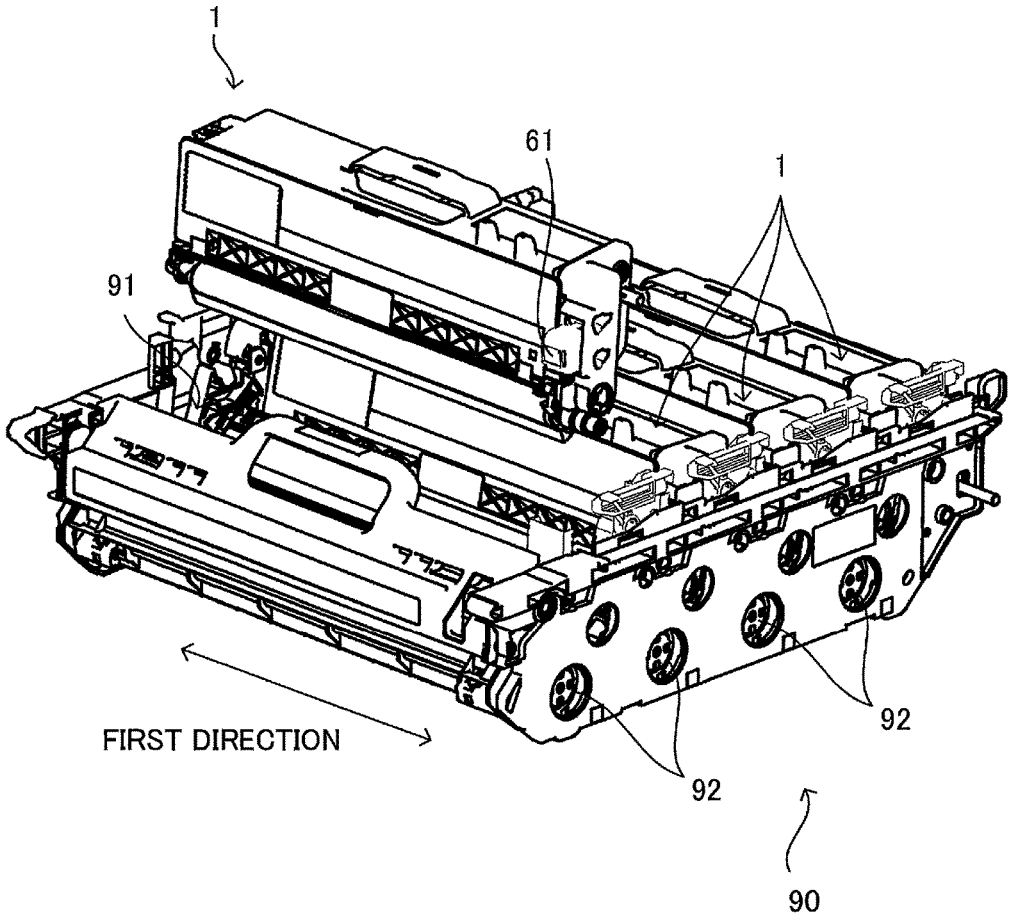
FIG. 2 is a perspective view of a drawer unit and a developing cartridge of the image forming apparatus according to the embodiment.

FIG. 2 is a perspective view of the drawer unit 90 and the developing cartridges 1. As illustrated in FIGS. 1 and 2, the four developing cartridges 1 are individually and replaceably mounted to the drawer unit 90. The drawer unit 90 is pulled out through an opening formed in a front wall of the image forming apparatus 100 to replace the developing cartridges 1. The drawer unit 90 has four slots 91. The developing cartridges 1 are mounted to and removed from the corresponding slots 91. The drawer unit 90 includes four photosensitive drums 92. The photosensitive drums 92 are positioned near bottom portions of the corresponding slots 91. Each of the photosensitive drums 92 is rotatable about a rotational axis extending in a first direction (described later).

In the embodiment, four developing cartridges 1 are mounted to a single drawer unit 90. The four developing cartridges 1 accommodate developer of different colors (cyan, magenta, yellow, and black, for example). However, the number of developing cartridges 1 mounted to the drawer unit 90 may be one, two, or three, or five or greater.

As illustrated in FIGS. 1 and 2, each of the four developing cartridges 1 includes an integrated circuit (chip) 61 as an example of a storage medium. The chips 61 are readable and writable storage media. That is, information can be written to or read from the chips 61. The image forming apparatus 100 further includes a control unit 80. When the four developing cartridges 1 are mounted to the drawer unit 90, the chip 61 on each developing cartridge 1 becomes electrically connected to the control unit 80. The control unit 80 is configured of a circuit board, for example. The control unit 80 includes a processor, such as a CPU, and various memory. The processor of the control unit 80 executes various processes of the image forming apparatus 100 according to a program.

2. Overall Structure of Developing Cartridge

Figure 3:
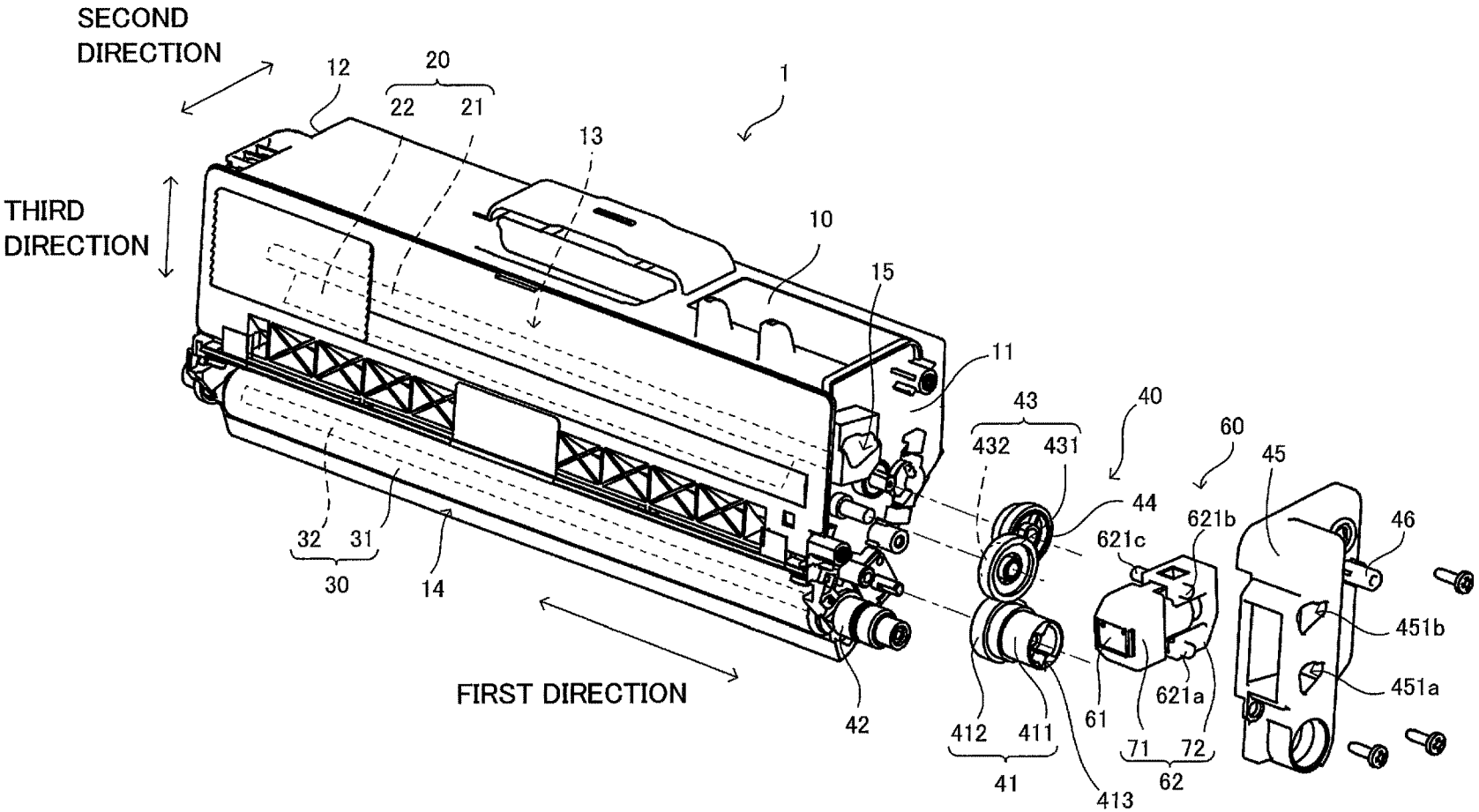
FIG. 3 is a perspective view of the developing cartridge according to the embodiment.

FIG. 3 is a perspective view of the developing cartridge 1. As illustrated in FIG. 3, the developing cartridge 1 according to the embodiment includes a casing 10, an agitator 20, a developing roller 30, a gear unit 40, and a chip assembly 60.

The casing 10 is a housing that can accommodate developer. The casing 10 has a first endface 11 and a second endface 12. The casing 10 extends in the first direction between the first endface 11 and the second endface 12. The gear unit 40 and the chip assembly 60 are positioned at the first endface 11. A developer chamber 13 is positioned inside the casing 10. The developer chamber 13 accommodates developer therein. The casing 10 has an opening portion 14. The opening portion 14 is formed at a downstream end portion of the casing 10 in an insertion direction in which the developing cartridge 1 is inserted into the drawer unit 90. The developer chamber 13 communicates with an outside of the casing 10 through the opening portion 14.

The agitator 20 includes an agitator shaft 21, and an agitating blade 22. The agitator shaft 21 extends in the first direction. The agitating blade 22 extends radially outward from the agitator shaft 21. The agitating blade 22 and at least a portion of the agitator shaft 21 are positioned inside the developer chamber 13. An agitator gear 44 (described later) is coupled to one end portion of the agitator shaft 21 in the first direction. Hence, the agitator shaft 21 and the agitating blade 22 rotate together with the agitator gear 44. When the agitating blade 22 rotates, the agitating blade 22 agitates developer inside the developer chamber 13.

The developing roller 30 is rotatable about a rotational axis extending in the first direction. The developing roller 30 is positioned at the opening portion 14 of the casing 10. The developing roller 30 according to the embodiment includes a developing-roller body 31, and a developing-roller shaft 32. The developing-roller body 31 is a hollow cylindrical member that extends in the first direction. The material used to form the developing-roller body 31 is an elastic rubber, for example. The developing-roller shaft 32 is a columnar-shaped member that penetrates the developing-roller body 31 in the first direction. The material used to form the developing-roller shaft 32 is either a metal or an electrically conductive resin. The developing-roller body 31 is fixed to the developing-roller shaft 32 so as to be incapable of rotating relative to the developing-roller shaft 32.

One end portion of the developing-roller shaft 32 in the first direction is fixed to a developing-roller gear 42 (described later) so as to be incapable of rotating relative to the developing-roller gear 42. Hence, as the developing-roller gear 42 rotates, the developing-roller shaft 32 rotates, and the developing-roller body 31 rotates together with the developing-roller shaft 32.

Note that the developing-roller shaft 32 need not penetrate the developing-roller body 31 in the first direction. For example, a pair of developing-roller shafts 32 may extend outward in the first direction from both ends of the developing-roller body 31 in the first direction.

The developing cartridge 1 further includes a supply roller that is not illustrated in the drawings. The supply roller is positioned between the developing roller 30 and the developer chamber 13. The supply roller is rotatable about a rotational axis extending in the first direction. When the developing cartridge 1 receives a drive force, the supply roller supplies developer from the developer chamber 13 inside the casing 10 onto an outer circumferential surface of the developing roller 30. At this time, the developer is tribocharged between the supply roller and the developing roller 30. In the meantime, a bias voltage is applied to the developing-roller shaft 32 of the developing roller 30. As a consequence, electrostatic force between the developing-roller shaft 32 and the developer attracts the developer onto an outer circumferential surface of the developing-roller body 31.

The developing cartridge 1 further includes a thickness-regulating blade that is not illustrated in the drawings. The thickness-regulating blade forms the developer supplied onto the outer circumferential surface of the developing-roller body 31 into a layer of uniform thickness. Subsequently, the developer on the outer circumferential surface of the developing-roller body 31 is supplied onto the corresponding photosensitive drum 92 positioned in the drawer unit 90. At this time, the developer moves from the developing-roller body 31 onto the photosensitive drum 92 in accordance with an electrostatic latent image formed on an outer circumferential surface of the photosensitive drum 92, thereby developing the electrostatic latent image into a visible image on the outer circumferential surface of the photosensitive drum 92.

The gear unit 40 is positioned at the first endface 11 of the casing 10. FIG. 3 illustrates the gear unit 40 in a disassembled state. As illustrated in FIG. 3, the gear unit 40 includes a coupling 41, the developing-roller gear 42, an idle gear 43, the agitator gear 44, and a cover 45. Note that while each of the coupling 41, the developing-roller gear 42, the idle gear 43, and the agitator gear 44 has a plurality of gear teeth, the gear teeth are not depicted in FIG. 3.

The coupling 41 is a gear that initially receives a drive force supplied from the image forming apparatus 100. The coupling 41 is rotatable about a rotational axis extending in the first direction. The coupling 41 includes a coupling portion 411, and a coupling gear 412. The coupling portion 411 and the coupling gear 412 may be integrally formed of resin, for example. A fastening hole 413 recessed in the first direction is provided in the coupling portion 411. The coupling gear 412 has a plurality of gear teeth arranged at regular intervals around an entire circumferential edge of the coupling gear 412.

When the drawer unit 90 with the developing cartridges 1 mounted thereto is inserted into the image forming apparatus 100, a drive shaft (not illustrated) in the image forming apparatus 100 is inserted into the fastening hole 413 of each coupling portion 411. Through this operation, the drive shaft and the coupling portion 411 are coupled together so as to be incapable of rotating relative to each other. Hence, as the drive shaft rotates, the coupling portion 411 rotates, and the coupling gear 412 rotates together with the coupling portion 411.

The developing-roller gear 42 is a gear that rotates the developing roller 30. The developing-roller gear 42 is rotatable about a rotational axis extending in the first direction. The developing-roller gear 42 has a plurality of gear teeth arranged at regular intervals around an entire circumferential edge of the developing-roller gear 42. A portion of the gear teeth of the coupling gear 412 meshes with a portion of the gear teeth of the developing-roller gear 42. Further, the developing-roller gear 42 is fixed to the one end portion of the developing-roller shaft 32 in the first direction so as to be incapable of rotating relative to the developing-roller shaft 32. Hence, as the coupling gear 412 rotates, the developing-roller gear 42 rotates, and the developing roller 30 rotates together with the developing-roller gear 42.

The idle gear 43 is a gear that transmits the rotation of the coupling gear 412 to the agitator gear 44. The idle gear 43 is rotatable about a rotational axis extending in the first direction. The idle gear 43 includes a large-diameter gear portion 431, and a small-diameter gear portion 432. The large-diameter gear portion 431 and the small-diameter gear portion 432 are aligned in the first direction. The small-diameter gear portion 432 is positioned between the large-diameter gear portion 431 and the first endface 11 of the casing 10 in the first direction. In other words, the large-diameter gear portion 431 is positioned farther from the first endface 11 than the small-diameter gear portion 432 is from the first endface 11. The small-diameter gear portion 432 has an addendum circle whose diameter is smaller than a diameter of an addendum circle of the large-diameter gear portion 431. The large-diameter gear portion 431 and the small-diameter gear portion 432 are integrally formed of resin, for example.

The large-diameter gear portion 431 has a plurality of gear teeth arranged at regular intervals around an entire circumferential edge of the large-diameter gear portion 431. The small-diameter gear portion 432 also has a plurality of gear teeth arranged at regular intervals around an entire circumferential edge of the small-diameter gear portion 432. A portion of the gear teeth of the coupling gear 412 meshes with a portion of the gear teeth of the large-diameter gear portion 431. Further, a portion of the gear teeth of the small-diameter gear portion 432 meshes with a portion of the gear teeth of the agitator gear 44. As the coupling gear 412 rotates, the large-diameter gear portion 431 rotates, and the small-diameter gear portion 432 rotates together with the large-diameter gear portion 431. The agitator gear 44 also rotates together with the rotation of the small-diameter gear portion 432.

The agitator gear 44 is a gear that rotates the agitator 20 inside the developer chamber 13. The agitator gear 44 is rotatable about a rotational axis extending in the first direction. The agitator gear 44 has a plurality of gear teeth arranged at regular intervals around an entire circumferential edge of the agitator gear 44. As described above, a portion of the gear teeth of the small-diameter gear portion 432 meshes with a portion of the gear teeth of the agitator gear 44. Further, the agitator gear 44 is fixed to the one end portion of the agitator shaft 21 in the first direction so as to be incapable of rotating relative to the agitator shaft 21. Accordingly, as a drive force is transmitted from the coupling 41 to the agitator gear 44 via the idle gear 43, the agitator gear 44 rotates, and the agitator 20 rotates together with the agitator gear 44.

The cover 45 is fixed to the first endface 11 of the casing 10 with screws, for example. The coupling gear 412, the developing-roller gear 42, the idle gear 43, and the agitator gear 44 are accommodated in a space between the first endface 11 and the cover 45. The fastening hole 413 of the coupling portion 411 is exposed to an outside of the cover 45. The cover 45 has a first columnar protrusion 46 that extends in the first direction. The cover 45 according to the embodiment also functions as a chip-holder cover that retains a chip holder 62 of the chip assembly 60 (described later). The structure of the cover 45 as the chip-holder cover will be described later.

3. Description of Chip Assembly

Figure 4:
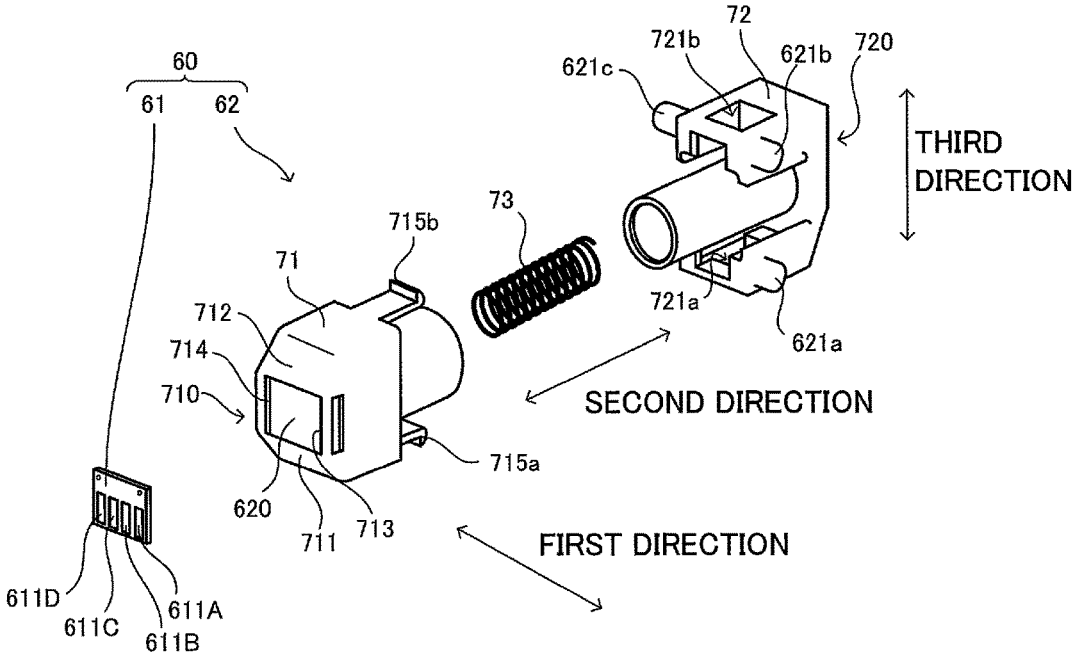
FIG. 4 is an exploded perspective view of a chip assembly of the developing cartridge according to the embodiment.
Figure 5:
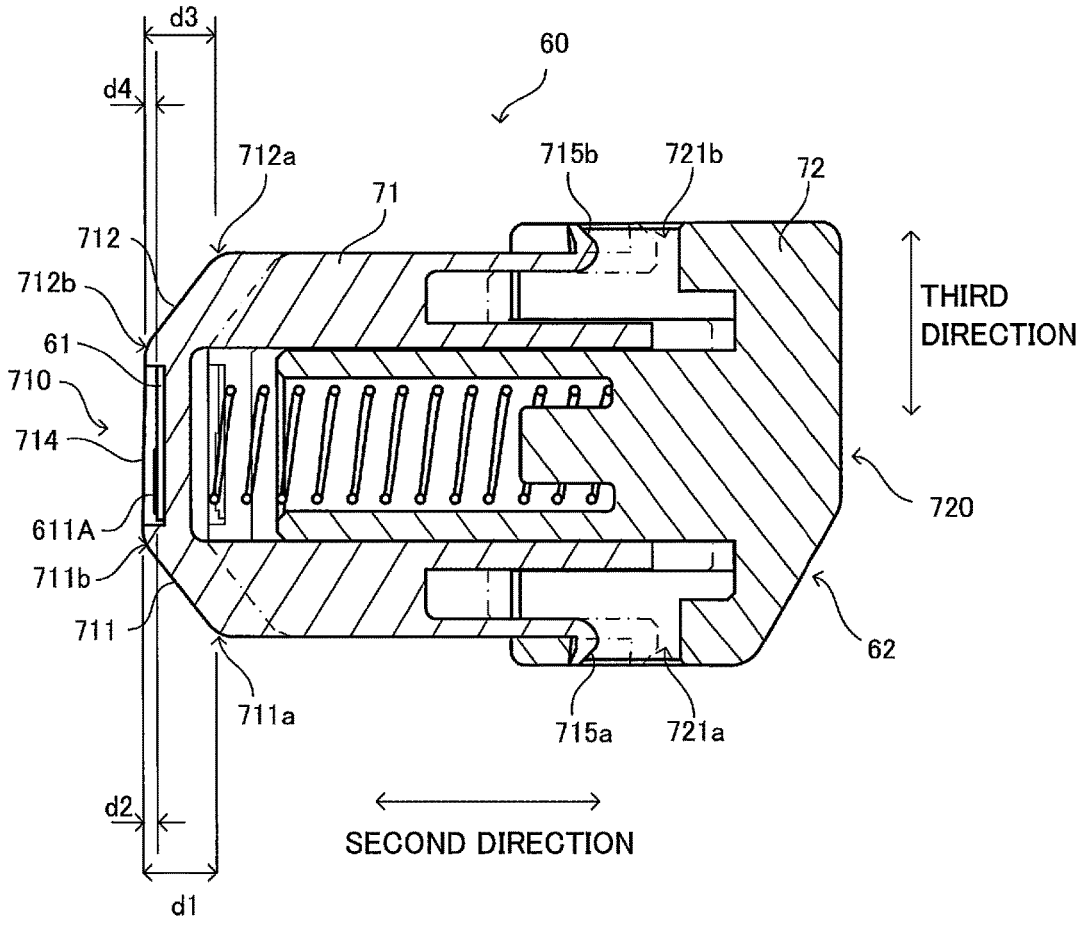
FIG. 5 is a cross-sectional view of the chip assembly according to the embodiment, taken along a plane orthogonal to a first direction.

The chip assembly 60 is positioned outside the first endface 11 of the casing 10. FIG. 4 is an exploded perspective view of the chip assembly 60. FIG. 5 is a cross-sectional view of the chip assembly 60 taken along a plane orthogonal to the first direction. The chip assembly 60 includes the chip 61 serving as a storage medium, and the chip holder 62 that retains the chip 61. The chip 61 is fixed to an outer surface of the chip holder 62. The chip holder 62 is retained between the casing 10 and the cover 45. The chip 61 has an electrical contact surface 611A, an electrical contact surface 611B, an electrical contact surface 611C, and an electrical contact surface 611D. The electrical contact surfaces 611A-611D are arrayed in the first direction. The electrical contact surfaces 611A-611D are formed of metal functioning as conductors. The chip 61 can store various information related to the developing cartridge 1.

Either the electrical contact surface 611A or the electrical contact surface 611D, that is, one of the two electrical contact surfaces 611A and 611D of the four electrical contact surfaces 611A-611D that are positioned on the ends in the first direction, is an example of a second electrical contact surface, while the other is an example of a third electrical contact surface. The electrical contact surfaces 611B and 611C positioned between the electrical contact surfaces 611A and 611D are an example of a first electrical contact surface.

In the following description, a direction crossing the electrical contact surfaces 611A-611D (a direction perpendicular to the electrical contact surfaces 611A-611D in the embodiment) will be referred to as a second direction. Further, the insertion direction in which the developing cartridges 1 are inserted into the slots 91 of the drawer unit 90 will be referred to as a third direction.

A portion of the chip holder 62 is covered by the cover 45. The chip holder 62 has a first boss 621*a*, a second boss 621*b*, and a third boss 621*c*. The first boss 621*a* and the second boss 621*b* extend toward the cover 45 in the first direction from a surface of the chip holder 62 opposite to a surface of the chip holder 62 facing the casing 10. The first boss 621*a* and the second boss 621*b* are aligned in the third direction. As illustrated in FIG. 3, the cover 45 has a first through-hole 451*a*, and a second through-hole 451*b*. The first through-hole 451*a* and the second through-hole 451*b* penetrate the cover 45 in the first direction. The first through-hole 451*a* and the second through-hole 451*b* are aligned in the third direction. The first boss 621*a* is inserted into the first through-hole 451*a*, and the second boss 621*b* is inserted into the second through-hole 451*b*.

The third boss 621*c* extends toward the casing 10 in the first direction from the surface of the chip holder 62 facing the casing 10. The casing 10 has a recessed portion 15 (see FIG. 3). The recessed portion 15 is recessed in the first direction from the first endface 11 of the casing 10. The third boss 621*c* is inserted into the recessed portion 15. Incidentally, the first boss 621*a*, the second boss 621*b*, and the third boss 621*c* all may have a circular pillar shape. Alternatively, the first boss 621*a*, the second boss 621*b*, and the third boss 621*c* all may have a different shape, such as a square pillar shape.

The first through-hole 451*a* has a length in the second direction (inner dimension) greater than a length of the first boss 621*a* in the second direction (outer dimension). The second through-hole 451*b* has a length in the second direction (inner dimension) greater than a length of the second boss 621*b* in the second direction (outer dimension). The recessed portion 15 has a length in the second direction (inner dimension) greater than a length of the third boss 621*c* in the second direction (outer dimension). Accordingly, the chip holder 62, together with the first boss 621*a*, the second boss 621*b*, and the third boss 621*c* of the chip holder 62, is movable in the second direction relative to the casing 10 and the cover 45. When the chip holder 62 moves in the second direction, the chip 61 having the electrical contact surfaces 611A-611D moves together with the chip holder 62 in the second direction.

Similarly, the first through-hole 451*a* has a length in the third direction (inner dimension) greater than a length of the first boss 621*a* in the third direction (outer dimension). The second through-hole 451*b* has a length in the third direction (inner dimension) greater than a length of the second boss 621*b* in the third direction (outer dimension). The recessed portion 15 has a length in the third direction (inner dimension) greater than a length of the third boss 621*c* in the third direction (outer dimension). Accordingly, the chip holder 62, together with the first boss 621*a*, the second boss 621*b*, and the third boss 621*c* of the chip holder 62, is movable in the third direction relative to the casing 10 and the cover 45. When the chip holder 62 moves in the third direction, the chip 61 having the electrical contact surfaces 611A-611D moves together with the chip holder 62 in the third direction.

Incidentally, the chip holder 62 may be movable between the first endface 11 of the casing 10 and the cover 45 in the first direction. Further, the number of bosses of the chip holder 62, the number of through-holes of the cover 45, and the number of recessed portions of the casing 10 are not limited to the example in the embodiment. Further, the cover 45 may have recessed portions in place of through-holes for inserting the bosses.

As illustrated in FIG. 4, the chip holder 62 has a first outer surface 710, and a second outer surface 720. The first outer surface 710 is positioned at one end of the chip holder 62 in the second direction. The second outer surface 720 is positioned at the other end of the chip holder 62 in the second direction. The second outer surface 720 is movable in the second direction relative to the first outer surface 710.

More specifically, the chip holder 62 according to the embodiment includes a first holder member 71, a second holder member 72, and a coil spring 73 positioned between the first holder member 71 and the second holder member 72. The first holder member 71 and the second holder member 72 are formed of resin, for example. The first holder member 71 has the first outer surface 710. The chip 61 is fixed to a retaining surface 620 included in the first outer surface 710. The second holder member 72 has the second outer surface 720. In a state where the first holder member 71, the second holder member 72, and the coil spring 73 are assembled to provide the chip holder 62, the first outer surface 710 and the second outer surface 720 are separated from each other in the second direction.

The coil spring 73 is a pressing portion that presses the electrical contact surfaces 611A-611D of the chip 61 in the second direction, that is, in a pressing direction. The coil spring 73 is positioned between the first outer surface 710 and the second outer surface 720 in the second direction. The coil spring 73 expands and contracts in the second direction between at least a first state, and a second state that is more contracted than the first state. Thus, the coil spring 73 has a length in the second direction that is greater when the coil spring 73 is in the first state than when the coil spring 73 is in the second state. Therefore, a distance in the second direction between the first outer surface 710 and the second outer surface 720 is greater when the coil spring 73 is in the first state than when the coil spring 73 is in the second state. The length of the coil spring 73 in the second direction is shorter than the natural length of the coil spring 73, at least when the coil spring 73 is in the second state.

As illustrated in FIG. 4, the first holder member 71 includes a first pawl 715*a*, and a second pawl 715*b*. The first pawl 715*a* and the second pawl 715*b* protrude from the first holder member 71 in directions crossing the second direction. The second holder member 72 has a first opening 721*a* and a second opening 721*b*. The first pawl 715*a* is inserted into the first opening 721*a*. The second pawl 715*b* is inserted into the second opening 721*b*. In the first state of the coil spring 73, the first pawl 715*a* contacts the second holder member 72 at an edge of the first opening 721*a* closer to the first outer surface 710. Also in the first state of the coil spring 73, the second pawl 715*b* contacts the second holder member 72 at an edge of the second opening 721*b* closer to the first outer surface 710. Through these contacts, the length of the coil spring 73 in the second direction is prevented from increasing more than the length of the coil spring 73 in the second direction in the first state. Further, this construction prevents the first holder member 71 from coming detached from the second holder member 72. In the second state of the coil spring 73, both the first pawl 715*a* and the second pawl 715*b* are separated from the second holder member 72 (see FIG. 8).

Incidentally, in place of the openings, the second holder member 72 may have recessed portions or stepped portions that is capable of contacting the pawls 715*a* and 715*b*. Further, the first holder member 71 may have openings, recessed portions, or stepped portions, while the second holder member 72 may have pawls.

The retaining surface 620 of the chip holder 62 is movable relative to the casing 10 in the second direction owing to the dimensional difference between the first through-hole 451*a* and the first boss 621*a*, the dimensional difference between the second through-hole 451*b* and the second boss 621*b*, the dimensional difference between the recessed portion 15 and the third boss 621*c*, and the expansion and contraction of the coil spring 73.

In the following description, a position of the retaining surface 620 and the electrical contact surfaces 611A-611D relative to the casing 10 in the second direction prior to the developing cartridge 1 being mounted to the drawer unit 90 will be referred to as an "initial position." A position of the retaining surface 620 and the electrical contact surfaces 611A-611D relative to the casing 10 in the second direction while the developing cartridge 1 is being mounted to the drawer unit 90 and the coil spring 73 is in its most compressed state will be referred to as an "intermediate position." A position of the retaining surface 620 and the electrical contact surfaces 611A-611D relative to the casing 10 in the second direction when the electrical contact surfaces 611A-611D contact terminal portions 913A-913D (described later) will be referred to as a "contact position." A position of the retaining surface 620 and the electrical contact surfaces 611A-611D relative to the casing 10 in the second direction after the developing cartridge 1 is completely mounted to the drawer unit 90 will be referred to as a "final position."

In addition to the retaining surface 620, the first outer surface 710 has a first surface 711, a second surface 712, a third surface 713, and a fourth surface 714.

The retaining surface 620 has one edge and the other edge in the third direction, and the one edge of the retaining surface 620 is closer to the developing roller 30 than the other edge of the retaining surface 620 is to the developing roller 30 in the third direction. That is, the other edge of the retaining surface 620 is farther from the developing roller 30 than the one edge of the retaining surface 620 is from the developing roller 30 in the third direction. The first surface 711 is positioned in proximity to the one edge of the retaining surface 620. That is, the first surface 711 is positioned opposite the other edge of the retaining surface 620 with respect to the one edge of the retaining surface 620 in the third direction. The first surface 711 slopes relative to the electrical contact surfaces 611A-611D of the chip 61 retained on the retaining surface 620.

Here, one edge of the first outer surface 710 in the third direction will be referred to as a "first outside edge 711*a*." Further, the one edge of the retaining surface 620 in the third direction will be referred to as a "first inside edge 711*b*." As illustrated in FIG. 5, the first surface 711 extends toward the electrical contact surfaces 611A-611D from the first outside edge 711*a* to the first inside edge 711*b*. The first outside edge 711*a* is farther from the electrical contact surfaces 611A-611D than the first inside edge 711*b* is from the electrical contact surfaces 611A-611D in both the second direction and the third direction. Further, as illustrated in FIG. 5, a distance d1 in the second direction between the first outside edge 711*a* and the first inside edge 711*b* is greater than a distance d2 in the second direction between the electrical contact surfaces 611A-611D and the first inside edge 711*b*.

The second surface 712 is positioned in proximity to the other edge of the retaining surface 620. That is, the second surface 712 is positioned opposite the one edge of the retaining surface 620 with respect to the other edge of the retaining surface 620 in the third direction. The second surface 712 slopes relative to the electrical contact surfaces 611A-611D of the chip 61 retained on the retaining surface 620.

Here, the other edge of the first outer surface 710 in the third direction will be referred to as a "second outside edge 712*a*." Further, the other edge of the retaining surface 620 in the third direction will be referred to as a "second inside edge 712*b*." As illustrated in FIG. 5, the second surface 712 extends toward the electrical contact surfaces 611A-611D from the second outside edge 712*a* to the second inside edge 712*b*. The second outside edge 712*a* is farther from the electrical contact surfaces 611A-611D than the second inside edge 712*b* is from the electrical contact surfaces 611A-611D in both the second direction and the third direction. Further, as illustrated in FIG. 5, a distance d3 in the second direction between the second outside edge 712*a* and the second inside edge 712*b* is greater than a distance d4 in the second direction between the electrical contact surfaces 611A-611D and the second inside edge 712*b*.

The third surface 713 is positioned in proximity to one of the electrical contact surfaces 611A-611D that is positioned at the one end in the first direction. In other words, in the embodiment, the third surface 713 is positioned in proximity to the electrical contact surface 611A. The fourth surface 714 is positioned in proximity to another of the electrical contact surfaces 611A-611D that is positioned at the other end in the first direction. In other words, in the embodiment, the fourth surface 714 is positioned in proximity to the electrical contact surface 611D. The third surface 713 and the fourth surface 714 extend in the third direction. Further, the electrical contact surfaces 611A-611D are disposed at positions recessed farther toward the coil spring 73 than the third surface 713 and the fourth surface 714 are toward the coil spring 73. Hence, the third surface 713 and the fourth surface 714 are farther away from the coil spring 73 than the electrical contact surfaces 611A-611D are from the coil spring 73 in the second direction.

Incidentally, the first surface 711, the second surface 712, the third surface 713, and the fourth surface 714 may each be flat or curved. However, it is preferable that the first surface 711, the second surface 712, the third surface 713, and the fourth surface 714 be smooth surfaces with no unevenness so that the developing cartridge 1 does not catch when being inserted into the drawer unit 90.

4. Description of Drawer Unit

Figure 6:
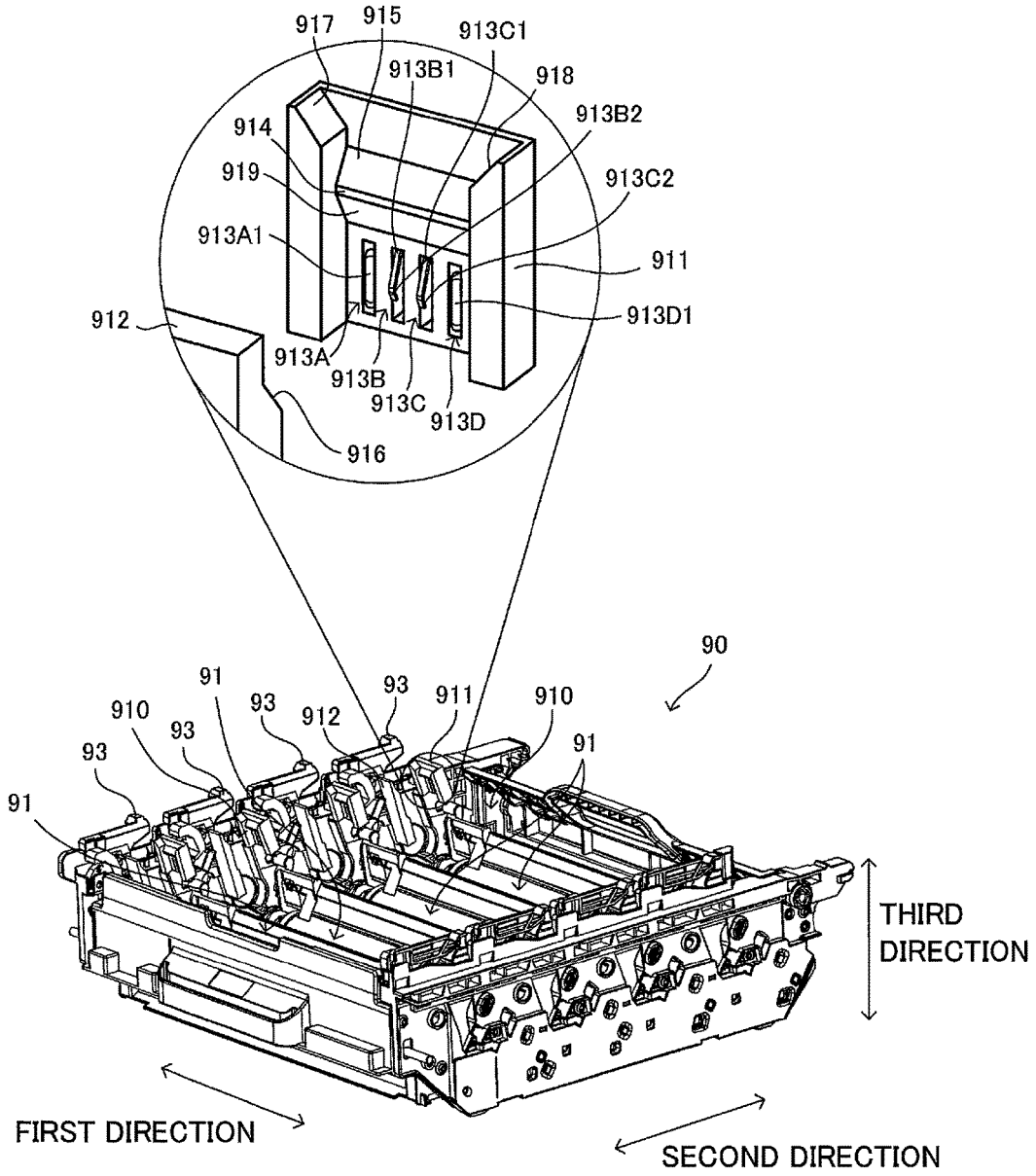
FIG. 6 is a perspective view of the drawer unit according to the embodiment.

FIG. 6 is a perspective view of the drawer unit 90. As described above, the drawer unit 90 has the four slots 91 in which the developing cartridges 1 can be mounted. Each slot 91 has an insertion opening 910. Each slot 91 has one end and the other end in the third direction, and the other end of the slot 91 is closer to the photosensitive drum 92 than the one end of the slot 91 is to the photosensitive drum 92 in the third direction. That is, the one end of the slot 91 is positioned opposite the photosensitive drum 92 with respect to the other end of the slot 91 in the third direction. The insertion opening 910 is positioned at the one end of the slot 91. That is, the insertion opening 910 is formed at a position opposite the photosensitive drums 92 with respect to the other end of the slot 91 in the third direction. Each slot 91 includes a first guide plate 911, and a second guide plate 912. The first guide plate 911 and the second guide plate 912 are positioned at one end of the slot 91 in the first direction.

The first guide plate 911 and the second guide plate 912 are arranged so as to face each other in the second direction while being separated by a gap in the second direction. The first guide plate 911 and the second guide plate 912 both expand in the first direction and the third direction. As will be described later in detail, the chip assembly 60 of the developing cartridge 1 is inserted between the first guide plate 911 and the second guide plate 912 when the developing cartridge 1 is mounted in the slot 91.

The first guide plate 911 has a terminal portion 913A, a terminal portion 913B, a terminal portion 913C, and a terminal portion 913D. The four terminal portions 913A-913D are arrayed in this order in the first direction. When the developing cartridge 1 is mounted to the slot 91, the terminal portion 913A contacts the electrical contact surface 611A of the chip 61 of the chip assembly 60, the terminal portion 913B contacts the electrical contact surface 611B of the chip 61 of the chip assembly 60, the terminal portion 913C contacts the electrical contact surface 611C of the chip 61 of the chip assembly 60, and the terminal portion 913D contacts the electrical contact surface 611D of the chip 61 of the chip assembly 60. The material used to form the terminal portions 913A-913D is a conductor, such as metal. The terminal portions 913A-913D are electrically connected to the control unit 80 of the image forming apparatus 100. The terminal portions 913A-913D supply electricity to the electrical contact surfaces 611A-611D through this contact. Note that the first guide plate 911 is an example of a plate.

Of the four terminal portions 913A-913D, one of the two terminal portions 913A and 913D that are positioned on the ends in the first direction is an example of a second electrical contact portion, while the other is an example of a third electrical contact portion. The terminal portions 913B and 913C positioned between the terminal portions 913A and 913D are an example of a first electrical contact portion.

The terminal portions 913A and 913D are fixed to the first guide plate 911. In other words, the terminal portions 913A and 913D are immovable relative to the first guide plate 911. The terminal portions 913A and 913D have respective linear portions 913A1 and 913D1 that extend linearly in the third direction. The linear portions 913A1 and 913D1 are arranged parallel to the electrical contact surfaces 611A and 611D of the chip 61. The linear portions 913A1 and 913D1 are supported to the first guide plate 911 at a side opposite the second guide plate 912 in the second direction. That is, the first guide plate 911 supports the linear portions 913A1 and 913D1 at a position opposite the second guide plate 912 with respect to the linear portions 913A1 and 913D1 in the second direction. The linear portions 913A1 and 913D1 protrude farther toward the second guide plate 912 in the second direction than a surface region of the first guide plate 911 surrounding the terminal portions 913A-913D. The terminal portions 913A and 913D have substantially the same height as each other in the second direction with respect to the surface region of the first guide plate 911.

The terminal portions 913B and 913C have plate shapes that extend in the third direction. The terminal portions 913B and 913C have respective fixed ends 913B1 and 913C1, and respective movable ends 913B2 and 913C2. The fixed ends 913B1 and 913C1 are positioned closer to the insertion opening 910 in the third direction, while the movable ends 913B2 and 913C2 are positioned closer to the photosensitive drum 92 in the third direction. The fixed ends 913B1 and 913C1 are fixed to the first guide plate 911. The terminal portions 913B and 913C gradually grow closer to the second guide plate 912 from the fixed ends 913B1 and 913C1 toward the movable ends 913B2 and 913C2, respectively. At least the movable ends 913B2 and 913C2 of the terminal portions 913B and 913C are positioned higher than the terminal portions 913A and 913D in the second direction with respect to the surface region of the first guide plate 911. In other words, at least portions of the terminal portions 913B and 913C are separated farther than the terminal portions 913A and 913D from the surface region of the first guide plate 911. With this configuration, the terminal portions 913B and 913C are pivotally movable about the fixed ends 913B1 and 913C1 so that the movable ends 913B2 and 913C2 move in the second direction relative to the surface region of the first guide plate 911, respectively.

Incidentally, there are no particular limitations on the shapes of the terminal portions 913B and 913C, provided that at least a portion of each of the terminal portions 913B and 913C is movable relative to the first guide plate 911. For example, the terminal portions 913B and 913C may be shaped like a leaf spring that is capable of expanding and contracting relative to the first guide plate 911.

As the developing cartridge 1 is mounted to the slot 91 of the drawer unit 90, the terminal portions 913A-913D receive a pressing force oriented in the second direction from the chip 61. Specifically, when the developing cartridge 1 is mounted to the slot 91, first the electrical contact surface 611B of the chip 61 contacts the terminal portion 913B and the electrical contact surface 611C contacts the terminal portion 913C. Further, a resilient force of the coil spring 73 causes the electrical contact surface 611B to press the terminal portion 913B toward the surface region of the first guide plate 911 and causes the electrical contact surface 611C to press the terminal portion 913C toward the surface region of the first guide plate 911. When the terminal portions 913B and 913C are pressed in this way, the movable ends 913B2 and 913C2 move toward the surface region of the first guide plate 911. As a consequence, the height of the terminal portions 913B and 913C in the second direction with respect to the surface region of the first guide plate 911 becomes substantially equivalent to the height of the terminal portions 913A and 913D in the second direction with respect to the surface of the first guide plate 911. At this time, the electrical contact surface 611A of the chip 61 contacts the terminal portion 913A and the electrical contact surface 611D contacts the terminal portion 913D.

When the developing cartridge 1 is removed from the slot 91, a pressing force in a direction from the second guide plate 912 toward the first guide plate 911 is no longer applied to the terminal portions 913A-913D, allowing the movable ends 913B2 and 913C2 of the terminal portions 913B and 913C to return to their original positions.

The terminal portions 913B and 913C are preferably grounded. When the developing cartridge 1 is being mounted to the slot 91, the two terminal portions 913B and 913C are the first of the four terminal portions 913A-913D to contact the chip 61. Accordingly, surge currents are more likely to occur in the terminal portions 913B and 913C. Grounding the terminal portions 913B and 913C can easily divert surge currents generated when mounting the developing cartridge 1.

The first guide plate 911 has a guide protrusion 914. The guide protrusion 914 is positioned closer to the insertion opening 910 than the terminal portions 913A-913D are to the insertion opening 910. The guide protrusion 914 protrudes toward the second guide plate 912 from the first guide plate 911. The first guide plate 911 has a first guide surface 915. In an example of FIG. 6, a sloped surface of the guide protrusion 914 facing the insertion opening 910 serves as the first guide surface 915. In addition, the second guide plate 912 has a second guide surface 916. A gap in the second direction between the first guide surface 915 and the second guide surface 916 gradually grows smaller toward the photosensitive drum 92 in the third direction.

When the developing cartridge 1 is inserted into the drawer unit 90, the first outer surface 710 of the chip holder 62 contacts the first guide surface 915, and the second outer surface 720 of the chip holder 62 contacts the second guide surface 916. Consequently, a distance in the second direction between the first outer surface 710 and the second outer surface 720 changes.

The first guide plate 911 also has a third guide surface 917, and a fourth guide surface 918. The third guide surface 917 and the fourth guide surface 918 fix the chip holder 62 in position in the first direction when the developing cartridge 1 is inserted into the drawer unit 90. The third guide surface 917 and the fourth guide surface 918 are positioned closer to the insertion opening 910 than the first guide surface 915 is to the insertion opening 910. The third guide surface 917 and the fourth guide surface 918 are arranged spaced apart from each other in the first direction. A gap between the third guide surface 917 and the fourth guide surface 918 in the first direction gradually grows smaller toward the first guide surface 915.

Figure 7:
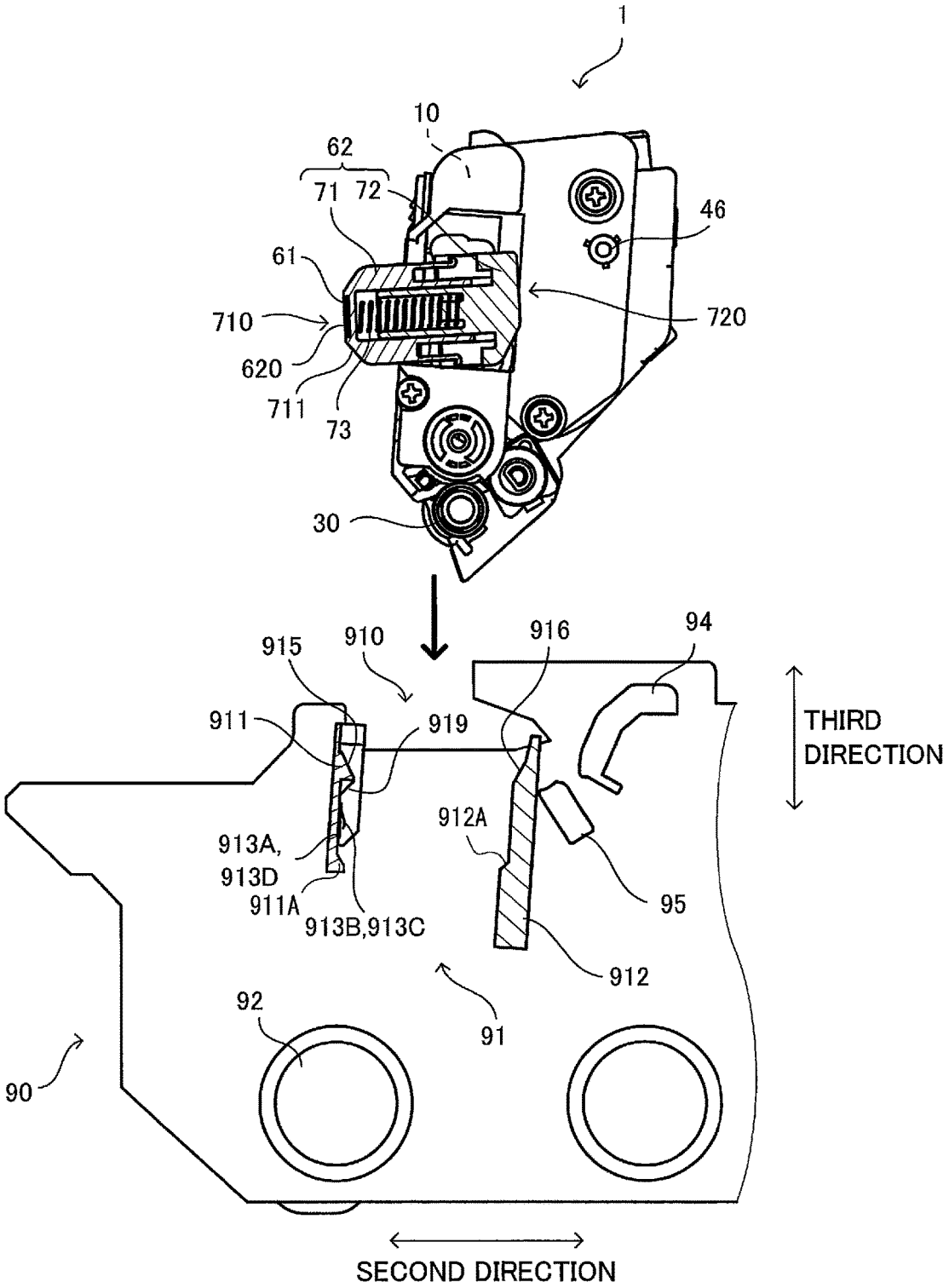
FIG. 7 is a view illustrating a state of the developing cartridge and the drawer unit according to the embodiment prior to the developing cartridge mounted in a slot of the drawer unit.

The second guide plate 912 also has a stopper surface 912A (see FIG. 7). The stopper surface 912A restricts movement of the chip holder 62 toward the photosensitive drum 92 after the developing cartridge 1 is inserted into the drawer unit 90. The stopper surface 912A is positioned at the second guide plate 912. The first guide plate 911 may similarly have a stopper surface 911A (see FIG. 7).

The first guide plate 911 also has a fifth guide surface 919. The fifth guide surface 919 restricts movement of the chip holder 62 toward the insertion opening 910 after the developing cartridge 1 is mounted to the drawer unit 90. The fifth guide surface 919 is positioned between the terminal portions 913A-913D and the first guide surface 915 in the third direction. In the example of FIG. 6, a sloped surface of the guide protrusion 914 facing the terminal portions 913A-913D serves as the fifth guide surface 919. However, the fifth guide surface 919 may be provided at at least one of the first guide plate 911 and the second guide plate 912.

5. Operations Performed When Mounting Developing Cartridge

5.1. Operations of Developing Cartridge

Figure 8:
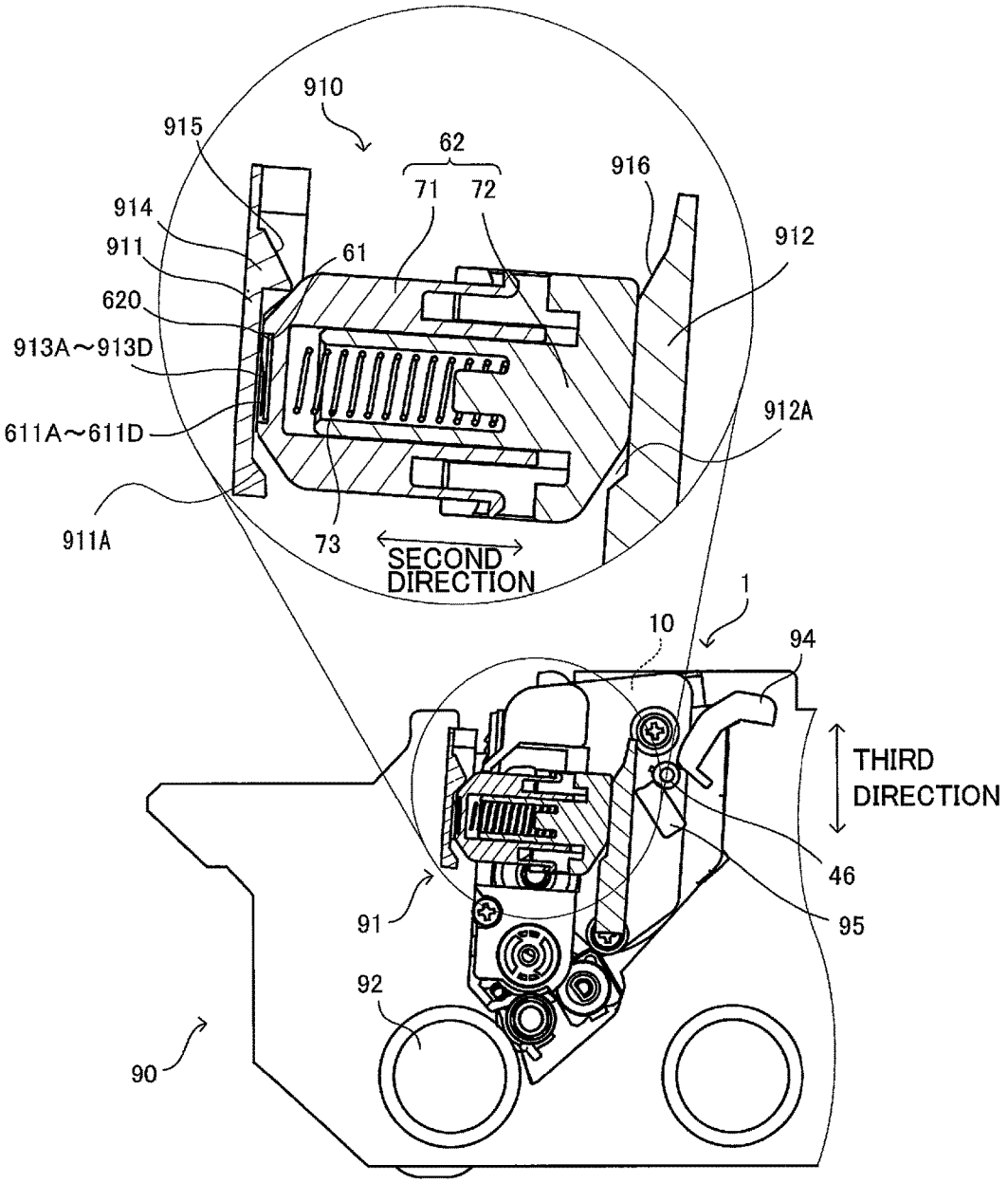
FIG. 8 is a view illustrating a state of the developing cartridge and the drawer unit according to the embodiment after the developing cartridge has been mounted in the slot of drawer unit.

Next, operations of the developing cartridge 1 performed when the developing cartridge 1 is mounted to the drawer unit 90 will be described. FIG. 7 illustrates a state of the developing cartridge 1 and the drawer unit 90 prior to the developing cartridge 1 being mounted to one of the slots 91 of the drawer unit 90. FIG. 8 illustrates a state of the developing cartridge 1 and the drawer unit 90 after the developing cartridge 1 has been mounted to the slot 91.

When mounting the developing cartridge 1 to the slot 91, first the developing cartridge 1 is positioned over the insertion opening 910 of the slot 91 so as to face the insertion opening 910, as illustrated in FIG. 7. At this time, the first outer surface 710 and the second outer surface 720 of the chip holder 62 are not yet in contact with the drawer unit 90. Therefore, the coil spring 73 is at the first state described above. Further, the retaining surface 620 and the electrical contact surfaces 611A-611D are at the initial position relative to the casing 10 in the second direction, as described above. The developing cartridge 1 is inserted into the slot 91 in the third direction, as indicated by the arrow in FIG. 7.

As the developing cartridge 1 is inserted into the slot 91, the first surface 711 of the chip holder 62 contacts an end of the first guide plate 911 in the third direction. Pressure applied by the first guide plate 911 to the first surface 711 moves the chip holder 62 in the second direction. In this way, the chip holder 62 moves relative to the casing 10. At this time, the chip holder 62 is fixed in position relative to the second direction between the first guide plate 911 and the second guide plate 912.

The chip holder 62 is also inserted in the third direction while contacting the third guide surface 917 and the fourth guide surface 918 (see FIG. 6). Through this contact, the chip holder 62 is fixed in position relative to the first direction. Thus, in the present embodiment, the chip holder 62 is fixed in position relative to the first direction prior to the electrical contact surfaces 611A-611D contacting the terminal portions 913A-913D. This configuration restrains the electrical contact surfaces 611A-611D from being displaced relative to the terminal portions 913A-913D in the first direction when contacting the terminal portions 913A-913D, thereby suppressing wear to the electrical contact surfaces 611A-611D.

The first outer surface 710 of the first holder member 71 contacts the first guide plate 911. The first outer surface 710 moves in the third direction along the surface of the first guide plate 911 as the developing cartridge 1 is inserted into the slot 91. Similarly, the second outer surface 720 of the second holder member 72 contacts the second guide plate 912. The second outer surface 720 moves in the third direction along the surface of the second guide plate 912 as the developing cartridge 1 is inserted into the slot 91. At this time, the coil spring 73 is compressed in the second direction from its first state.

As the developing cartridge 1 is inserted further in the third direction, the first holder member 71 contacts the first guide surface 915, and the second holder member 72 contacts the second guide surface 916, thereby moving the first holder member 71 and the second holder member 72 closer to each other in the second direction. Hence, the first outer surface 710 and the second outer surface 720 move closer to each other in the second direction, and the length of the coil spring 73 gradually shortens in the second direction. When the third surface 713 and the fourth surface 714 of the first holder member 71 eventually contact the apex of the guide protrusion 914 (see FIG. 6), the coil spring 73 has reached its shortest length in the second direction. That is, the coil spring 73 is in its shortest state and is shorter than when in the second state described above. Further, the retaining surface 620 and the electrical contact surfaces 611A-611D are at the intermediate position described above relative to the casing 10 in the second direction.

In this way, the chip assembly 60 can change the position in the second direction of the retaining surface 620 that retains the chip 61 when the developing cartridge 1 is inserted into the drawer unit 90. Accordingly, the position of the retaining surface 620 and the electrical contact surfaces 611A-611D in the second direction can be changed along the guide protrusion 914 as the developing cartridge 1 is inserted into the drawer unit 90. Hence, the developing cartridge 1 can be inserted into the drawer unit 90 while suppressing wear to the electrical contact surfaces 611A-611D of the chip 61.

In particular, in the developing cartridge 1 according to the embodiment, the electrical contact surfaces 611A-611D of the chip 61 are arranged at positions recessed inward from the third surface 713 and the fourth surface 714. Accordingly, in a state where the third surface 713 and the fourth surface 714 of the first holder member 71 are in contact with the apex of the guide protrusion 914, the apex of the guide protrusion 914 only contacts the third surface 713 and the fourth surface 714 and does not contact the electrical contact surfaces 611A-611D. Hence, this configuration prevents the guide protrusion 914 from rubbing against the electrical contact surfaces 611A-611D.

When the developing cartridge 1 is inserted further in the third direction, the third surface 713 and the fourth surface 714 move past the guide protrusion 914, and the second surface 712 comes into contact with the guide protrusion 914. At this time, the coil spring 73 again expands from its shortest state to the second state described above. As a result, the electrical contact surfaces 611A-611D come into contact with the terminal portions 913A-913D, thereby enabling the control unit 80 of the image forming apparatus 100 to perform at least one of an operation for reading information from the chip 61 and an operation for writing information to the chip 61. The contact between the electrical contact surfaces 611A-611D and the terminal portions 913A-913D will be described later in detail.

The drawer unit 90 further includes pressure members 94 and pressing members 95 (see FIGS. 7 and 8). The pressure members 94 are positioned one on each end of the slot 91 in the first direction. The pressing members 95 are positioned one on each end of the slot 91 in the first direction. When the developing cartridge 1 is mounted to the drawer unit 90, the first columnar protrusion 46 is positioned between the pressure member 94 and the pressing member 95 on one end of the slot 91 in the first direction. A columnar protrusion of the second endface 12 of the casing 10 is also positioned between the pressure member 94 and the pressing member 95 on the other end of the slot 91 in the first direction. The pressure members 94 press these columnar protrusions in the third direction toward the photosensitive drum 92.

The length of the coil spring 73 in the second direction when the coil spring 73 is in the second state is shorter than the length of the coil spring 73 in the first state and longer than the coil spring 73 in its shortest state. Further, the position of the retaining surface 620 and the electrical contact surfaces 611A-611D relative to the casing 10 in the second direction is the contact position described above.

In this way, the electrical contact surfaces 611A-611D directly contact the terminal portions 913A-913D after the first outer surface 710 rides over the guide protrusion 914. Hence, the positions at which the terminal portions 913A-913D contact the electrical contact surfaces 611A-611D are unlikely to change after the contact is established, thereby further reducing wear to the electrical contact surfaces 611A-611D.

A distance between the terminal portions 913A-913D and the second guide plate 912 in the second direction is shorter than a distance between the electrical contact surfaces 611A-611D and the second outer surface 720 in the second direction prior to the developing cartridge 1 being mounted to the drawer unit 90. Therefore, the length of the coil spring 73 in the second direction when the coil spring 73 is in the state illustrated in FIG. 8 is shorter than the natural length of the coil spring 73. Accordingly, the resilient force (restoring force) of the coil spring 73 presses the electrical contact surfaces 611A-611D against the terminal portions 913A-913D. Thus, this arrangement can maintain proper contact between the electrical contact surfaces 611A-611D and the terminal portions 913A-913D.

As illustrated in FIG. 8, the chip assembly 60 is fixed in a state interposed between the first guide plate 911 and the second guide plate 912. Subsequently, the casing 10 is tilted relative to the second direction in the embodiment, whereby the developing roller 30 contacts the photosensitive drum 92 of the drawer unit 90. At this time, the position of the retaining surface 620 and the electrical contact surfaces 611A-611D relative to the casing 10 in the second direction is changed from the contact position described above to the final position described above. Further, the first boss 621*a* moves in the second direction within the first through-hole 451*a*, the second boss 621*b* moves in the second direction within the second through-hole 451*b*, and the third boss 621*c* moves in the second direction within the recessed portion 15. Through this action, the chip holder 62 is not in contact with the casing 10 and the cover 45. Thus, vibrations occurring in the gear unit 40 and other drive units when the image forming apparatus 100 executes a printing process are not likely to be transmitted to the chip assembly 60, thereby more reliably maintaining states of contact between the electrical contact surfaces 611A-611D and the terminal portions 913A-913D.

5.2. Operations of Terminal Parts

Next, operations of the terminal portions 913B and 913C that move in the second direction when contacted by the electrical contact surfaces 611A-611D of the chip 61 will be described in detail.

Figure 9:
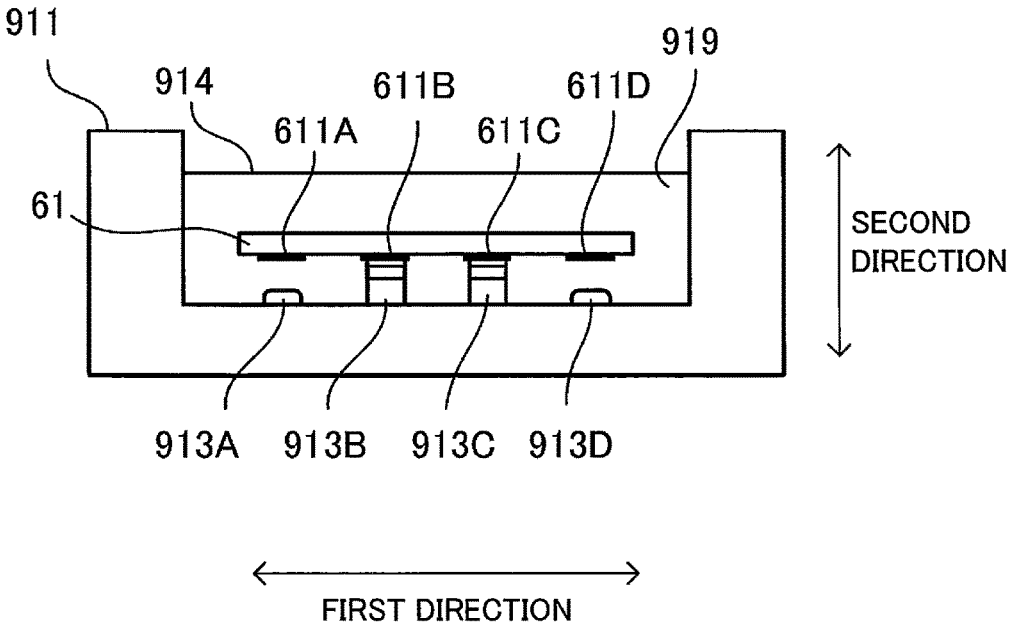
FIG. 9 is a view illustrating a state of electrical contact surfaces of the developing cartridge and terminal portions of the drawer unit according to the embodiment when the electrical contact surfaces contact the terminal portions.
Figure 10:
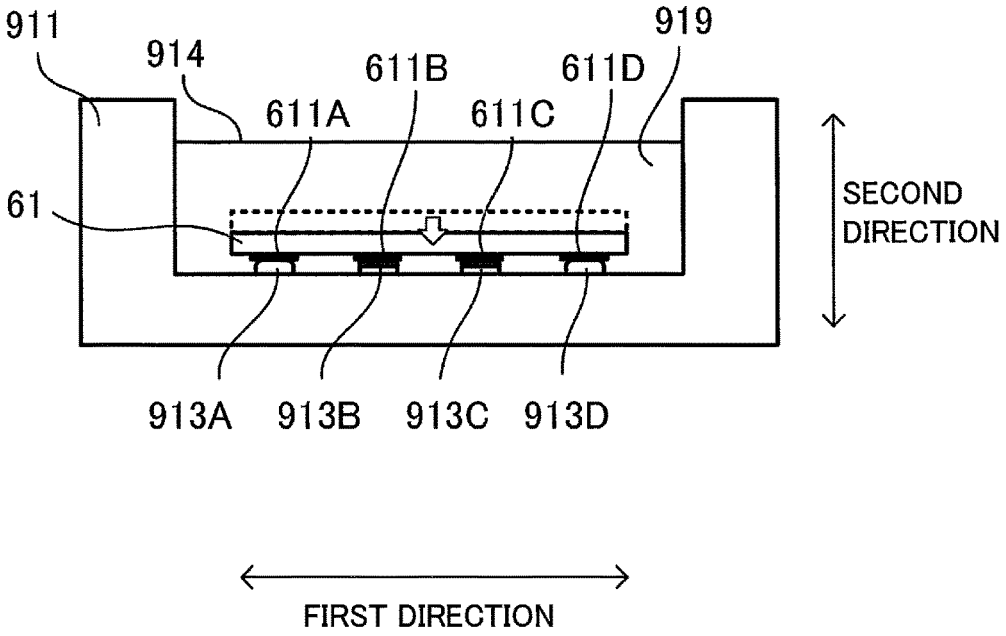
FIG. 10 is a view illustrating a state of the electrical contact surfaces of the developing cartridge and the terminal portions of the drawer unit according to the embodiment when the electrical contact surfaces contact the terminal portions.

FIGS. 9 and 10 illustrate the states of contact between the electrical contact surfaces 611A-611D and the terminal portions 913A-913D. FIGS. 9 and 10 illustrate the terminal portions 913A-913D as viewed in the third direction in order to explain the heights of the terminal portions 913A-913D in the second direction.

As described above, portions of the terminal portions 913B and 913C protrude farther in the second direction than the terminal portions 913A and 913D from the surface region of the first guide plate 911 toward the second guide plate 912. Therefore, immediately after the first outer surface 710 of the chip holder 62 (see FIG. 7) passes over the guide protrusion 914, first the electrical contact surface 611B of the chip 61 contacts the terminal portion 913B and the electrical contact surface 611C contacts the terminal portion 913C, as illustrated in FIG. 9. At this time, the electrical contact surface 611A of the chip 61 does not contact the terminal portion 913A. Further, the electrical contact surface 611D of the chip 61 does not contact the terminal portion 913D, either.

From the state illustrated in FIG. 9, the chip 61 presses the terminal portion 913B toward the surface region of the first guide plate 911 with the electrical contact surface 611B and presses the terminal portion 913C toward the surface region of the first guide plate 911 with the electrical contact surface 611C through the resilient force of the coil spring 73 in the chip holder 62 (see FIG. 8). As described above, the terminal portions 913B and 913C move in the second direction. When pressed in the direction from the second guide plate 912 toward the first guide plate 911, the terminal portions 913B and 913C move toward the surface region of the first guide plate 911. At this time, the height of the terminal portions 913B and 913C in the second direction with respect to the surface region of the first guide plate 911 is equivalent to the height of the terminal portions 913A and 913D in the second direction with respect to the surface region of the first guide plate 911. Accordingly, the terminal portions 913A and 913D contact the electrical contact surfaces 611A and 611D, respectively, as illustrated in FIG. 10.

The terminal portions 913A and 913D are stationary relative to the slot 91. Accordingly, when the height of the terminal portions 913B and 913C in the second direction with respect to the surface region of the first guide plate 911 become equivalent to the height of the terminal portions 913A and 913D in the second direction with respect to the surface region of the first guide plate 911, movement of the terminal portions 913B and 913C in the second direction is halted. At this time, the electrical contact surface 611A is in contact with the terminal portion 913A, the electrical contact surface 611B is in contact with the terminal portion 913B, the electrical contact surface 611C is in contact with the terminal portion 913C, and the electrical contact surface 611D is in contact with the terminal portion 913D. Further, the chip 61 is supported to the first guide plate 911 so that both ends of the chip 61 in the first direction are supported by the terminal portions 913A and 913D that do not move relative to the first guide plate 911. Accordingly, the orientation of the chip 61 is kept stable with no play in the second direction. Thus, this configuration can maintain a stable state of contact between the terminal portions 913A-913D and the electrical contact surfaces 611A-611D.

Further, the pressing force applied by the chip 61 toward the first guide plate 911 need only be sufficient to move the two terminal portions 913B and 913C and, hence, may be smaller than the pressing force required to move all the four terminal portions 913A-913D. In other words, the resilient force of the coil spring 73 can be smaller. When the resilient force of the coil spring 73 is small, less force is required to be applied to the first outer surface 710 in the second direction when the first outer surface 710 rides over the guide protrusion 914. Thus, this configuration can reduce the insertion load when inserting the developing cartridge 1 into the drawer unit 90.

6. Description of Separation Operation

After the developing cartridges 1 have been mounted to the drawer unit 90, the image forming apparatus 100 can perform a separation operation. Here, the separation operation denotes an operation to move the developing rollers 30 temporarily apart from the corresponding photosensitive drums 92.

The drawer unit 90 further includes separating levers 93 (see FIG. 6). In the separation operation, the separating levers 93 are pressed by a drive force supplied from the image forming apparatus 100. This pressure causes the pressing members 95 to move in the third direction toward the corresponding pressure members 94. Consequently, the pressing members 95 positioned at the one end of the slots 91 in the first direction contact the corresponding first columnar protrusions 46 and press the first columnar protrusions 46 toward the corresponding insertion openings 910 against the pressure applied by the corresponding pressure members 94. Similarly, the pressing members 95 at the other end of the slots 91 in the first direction contact the corresponding columnar protrusions and press these protrusions toward the corresponding insertion openings 910 against the pressure applied by the corresponding pressure members 94. Through this operation, the casings 10 and the developing rollers 30 of the developing cartridges 1 move in the third direction, thereby separating the developing rollers 30 from the corresponding photosensitive drums 92.

Whether the developing roller 30 and the corresponding photosensitive drum 92 are in a state of contact or in a state of separation, the chip assembly 60 is fixed in a state interposed between the terminal portions 913A-913D and the second guide plate 912. At this time, the electrical contact surface 611A is in contact with the terminal portion 913A, the electrical contact surface 611B is in contact with the terminal portion 913B, the electrical contact surface 611C is in contact with the terminal portion 913C, and the electrical contact surface 611D is in contact with the terminal portion 913D. The chip holder 62 is not in contact with the casing 10 and the cover 45. Further, the first guide plate 911 and the second guide plate 912 is also not in contact with the casing 10 and the cover 45. Hence, in the separation operation, the casing 10 is movable relative to the chip holder 62 in a state where the chip holder 62 is fixed between the first guide plate 911 and the second guide plate 912.

In other words, while the casing 10 and the developing roller 30 move in the third direction during the separation operation, the position of the chip assembly 60 does not change relative to the drawer unit 90. Further, the coil spring 73 remains in the second state. Hence, the electrical contact surfaces 611A-611D remain fixed in position relative to the drawer unit 90, while the position of the casing 10 in the third direction changes. Therefore, the electrical contact surface 611A and the terminal portion 913A are maintained in a state of contact; the electrical contact surface 611B and the terminal portion 913B are maintained in a state of contact; the electrical contact surface 611C and the terminal portion 913C are maintained in a state of contact; and the electrical contact surface 611D and the terminal portion 913D are maintained in a state of contact.

Note that the separating direction in the embodiment described above, i.e., the direction in which the developing roller 30 separates from the corresponding photosensitive drum 92 in the separation operation, is the third direction. However, the separating direction may be any direction other than the third direction. The separating direction may be a direction that crosses the direction in which the electrical contact surfaces 611A-611D face the terminal portions 913A-913D.

As described above, the present embodiment can reduce the insertion load for inserting the developing cartridge 1 into the drawer unit 90. If it is desirable to reduce the insertion load for inserting developing cartridges 1 into the drawer unit 90, it is necessary to adjust the pressing force applied by the terminal portions 913A-913D to the chip 61 and the pressing force applied by the chip 61 to the terminal portions 913A-913D. Hence, the insertion load can be reduced by reducing the pressing force applied by the chip 61 to the terminal portions 913A-913D, as described above.

7. Variations of Embodiment

While the description has been made in detail with reference to the embodiment thereof, it would be apparent to those skilled in the art that many modifications and variations may be made therein without departing from the scope of the disclosure.

7.1. First Variation

A first guide plate 1911 according to a first variation of the embodiment will be described with reference to FIG. 11, wherein like parts and components are designated by the same reference numerals as those of the above-described embodiment to avoid duplicating description.

Figure 11:
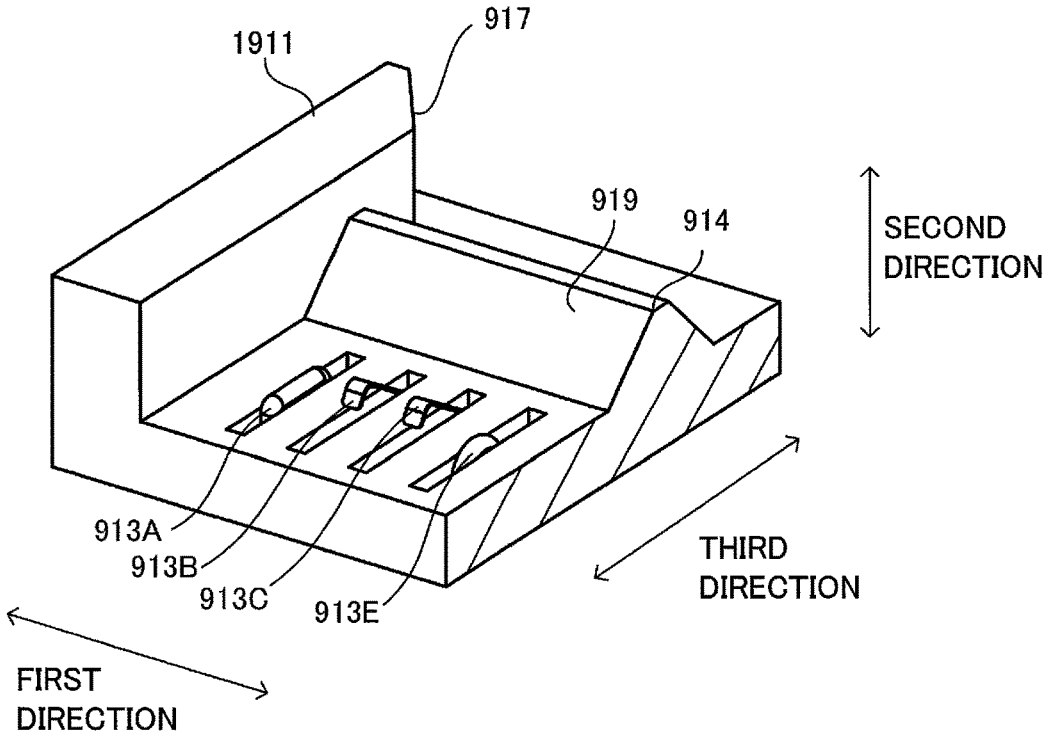
FIG. 11 is a perspective view of a first guide plate according to a first variation of the embodiment.

FIG. 11 is a perspective view of the first guide plate 1911 according to the first variation. Note that a portion of the first guide plate 1911 where the fourth guide surface 918 (see FIG. 6) is positioned has been omitted from FIG. 11.

The first guide plate 1911 has a terminal portion 913E in place of the terminal portion 913D of the embodiment. The terminal portion 913E has a different shape from the terminal portion 913D.

The terminal portion 913D in the embodiment described above has the linear portion 913D1 that extends linearly along the surface region of the first guide plate 911. The linear portion 913D1 comes into line contact with the electrical contact surface 611D of the chip 61. In contrast, the terminal portion 913E of the first variation has a length in the third direction shorter than a length of the linear portion 913D1 of the terminal portion 913D in the third direction. The terminal portion 913E protrudes in an arcuate shape from a surface region of the first guide plate 1911 surrounding the terminal portions 913A-913C and 913E. An apex of the terminal portion 913E in the second direction comes into point contact with the electrical contact surface 611D of the chip 61.

Here, the terminal portion 913A may also have the same shape as the terminal portion 913E and may be configured to come into point contact with the electrical contact surface 611A of the chip 61. Further, one of the terminal portions 913B and 913C may be movable relative to the first guide plate 1911, while the other of the terminal portions 913B and 913C may have the same shape as the terminal portion 913A or the terminal portion 913E.

7.2. Second Variation

A first guide plate 2911 according to a second variation of the embodiment will be described with reference to FIG. 12, wherein like parts and components are designated by the same reference numerals as those of the above-described embodiment and variation to avoid duplicating description.

Figure 12:
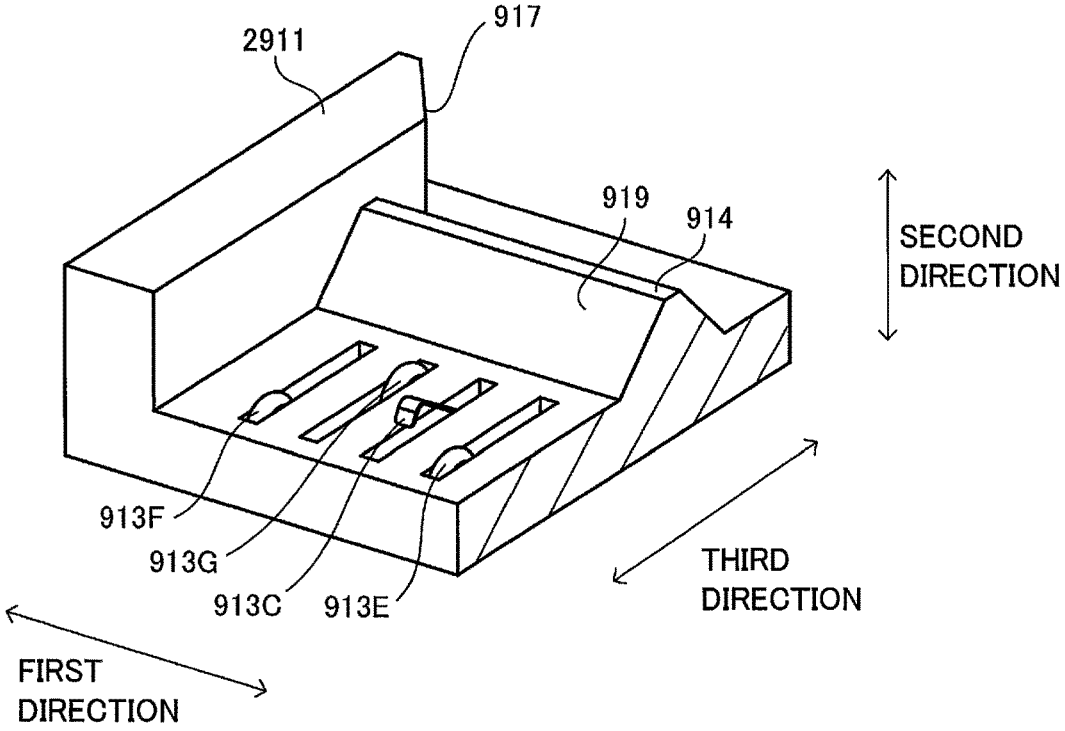
FIG. 12 is a perspective view of a first guide plate according to a second variation of the embodiment.

FIG. 12 is a perspective view of the first guide plate 2911 according to the second variation. Note that a portion of the first guide plate 2911 where the fourth guide surface 918 (see FIG. 6) is positioned has been omitted from FIG. 12.

The first guide plate 2911 has the terminal portion 913E in place of the terminal portion 913D of the embodiment. The terminal portion 913E has a different shape from the terminal portion 913D, as described above. Further, the first guide plate 2911 has a terminal portion 913F in place of the terminal portion 913A of the embodiment. The terminal portion 913F has a different shape from the terminal portion 913A. Still further, the first guide plate 2911 has a terminal portion 913G in place of the terminal portion 913B of the embodiment. While the terminal portion 913B is movable in the second direction, the terminal portion 913G is immovable in the second direction.

The terminal portion 913F has the same shape as the terminal portion 913E described in the first variation. The terminal portion 913F has a height in the second direction with respect to a surface region of the first guide plate 2911 surrounding the terminal portions 913F, 913G, 913C, and 913E equivalent to a height of the terminal portion 913E in the second direction with respect to the surface region of the first guide plate 911. The apex of the terminal portion 913F in the second direction comes into point contact with the electrical contact surface 611A of the chip 61. Further, the terminal portion 913G has the same shape as the terminal portions 913E and 913F. Thus, the terminal portion 913G has a height in the second direction with respect to the surface region of the first guide plate 2911 equivalent to the height of the terminal portions 913E and 913F in the second direction with respect to the surface region of the first guide plate 2911. The apex of the terminal portion 913G in the second direction comes into point contact with the electrical contact surface 611B of the chip 61.

The terminal portions 913F and 913E are disposed at the same position as each other in the third direction. However, the terminal portions 913F and 913E are disposed at different positions from the terminal portion 913G in the third direction. Thus, the chip 61 is supported at three points by the three terminal portions 913F, 913G, and 913E. Hence, the orientation of the chip 61 is stable, thereby easily maintaining a state of contact between the terminal portion 913F and the electrical contact surface 611A, a state of contact between the terminal portion 913G and the electrical contact surface 611B, a state of contact between the terminal portion 913C and the electrical contact surface 611C, and a state of contact between the terminal portion 913E and the electrical contact surface 611D.

As an alternative, each of the terminal portions 913F, 913G, and 913E may be disposed at different positions in the third direction.

7.3. Third Variation

A first guide plate 3911 according to a third variation of the embodiment will be described with reference to FIG. 13, wherein like parts and components are designated by the same reference numerals as those of the above-described embodiment and variations to avoid duplicating description.

Figure 13:
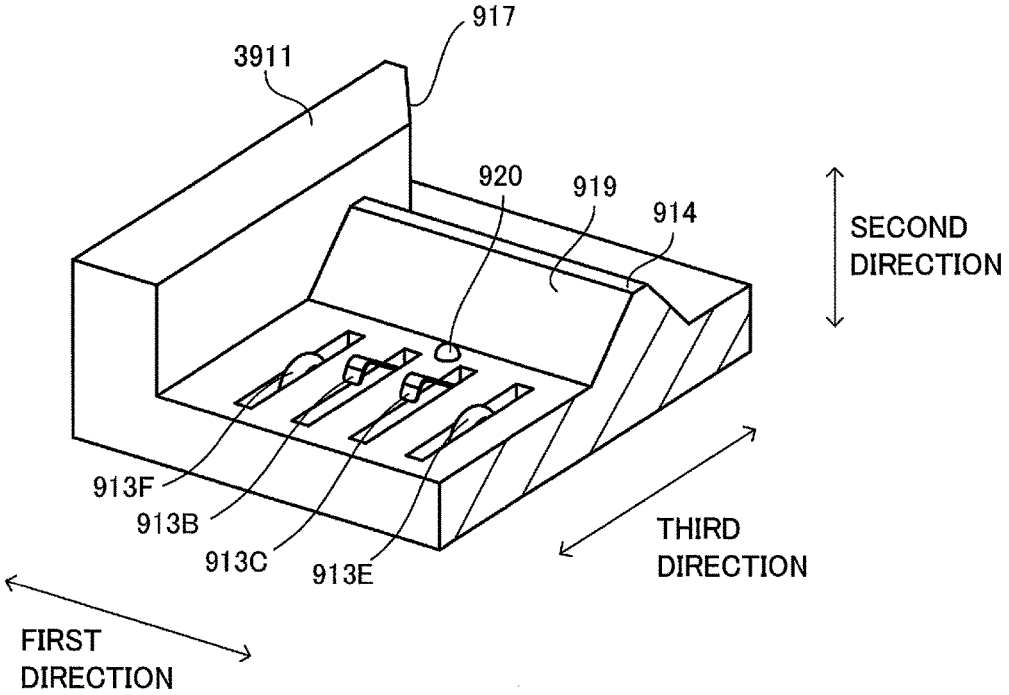
FIG. 13 is a perspective view of a first guide plate according to a third variation of the embodiment.

FIG. 13 is a perspective view of the first guide plate 3911 according to the third variation. Note that a portion of the first guide plate 3911 where the fourth guide surface 918 (see FIG. 6) is positioned has been omitted from FIG. 13.

The first guide plate 3911 has the terminal portion 913E in place of the terminal portion 913D of the embodiment. The terminal portion 913E has a different shape from the terminal portion 913D, as described above. Further, the first guide plate 911 has the terminal portion 913F in place of the terminal portion 913A of the embodiment. The terminal portion 913F has a different shape from the terminal portion 913A, as described above. Still further, the first guide plate 3911 has a support portion 920. The support portion 920 is positioned at a surface region of the first guide plate 3911 surrounding the terminal portions 913F, 913B, 913C, and 913E.

The terminal portions 913F and 913E are identical to those described in the first and second variations, and a description of these portions will not be repeated. The terminal portions 913F and 913E may be at the same or different positions in the third direction.

The support portion 920 protrudes in the second direction from the surface region of the first guide plate 3911. The support portion 920 has a semispherical shape. The support portion 920 has a height in the second direction with respect to the surface region of the first guide plate 3911 equivalent to a height of the terminal portions 913E and 913F in the second direction with respect to the surface region of the first guide plate 3911. Further, the support portion 920 is disposed at a position different from the terminal portions 913F and 913E in the third direction. The surface of the chip 61 at which the electrical contact surfaces 611A-611D are positioned contacts the support portion 920. Hence, the chip 61 is supported at three points by the support portion 920 and the terminal portions 913F and 913E. Thus, the orientation of the chip 61 is stable, thereby easily maintaining a state of contact between the terminal portion 913F and the electrical contact surface 611A, a state of contact between the terminal portion 913B and the electrical contact surface 611B, a state of contact between the terminal portion 913C and the electrical contact surface 611C, and a state of contact between the terminal portion 913E and the electrical contact surface 611D.

Note that the support portion 920 may be formed integrally with the first guide plate 3911 or may be formed as a separate member from the first guide plate 3911.

7.4. Fourth Variation

A first guide plate 4911 according to a fourth variation of the embodiment will be described with reference to FIG. 14, wherein like parts and components are designated by the same reference numerals as those of the above-described embodiment and variations to avoid duplicating description.

Figure 14:
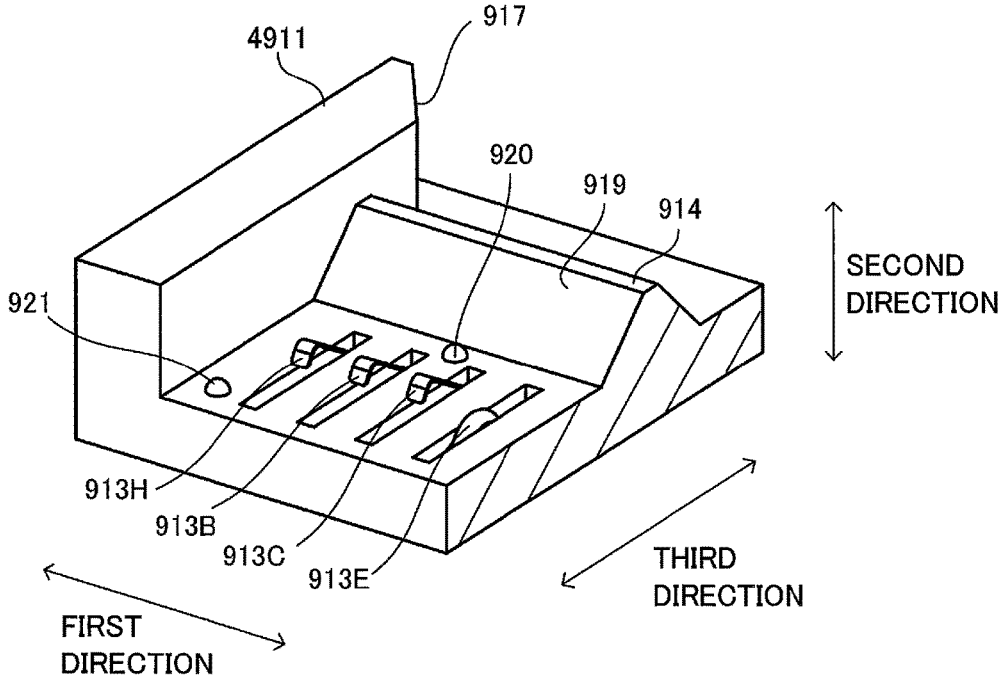
FIG. 14 is a perspective view of a first guide plate according to a fourth variation of the embodiment.

FIG. 14 is a perspective view of the first guide plate 4911 according to the fourth variation. Note that a portion of the first guide plate 4911 where the fourth guide surface 918 (see FIG. 6) is positioned has been omitted from FIG. 14.

The first guide plate 4911 has the terminal portion 913E in place of the terminal portion 913D of the embodiment. The terminal portion 913E has a different shape from the terminal portion 913D, as described above. Further, the first guide plate 4911 has a terminal portion 913H in place of the terminal portion 913A of the embodiment. While the terminal portion 913A of the embodiment is immovable in the second direction, the terminal portion 913H is movable in the second direction. Still further, the first guide plate 4911 has support portions 920 and 921. The support portions 920 and 921 are positioned at a surface region of the first guide plate 4911 surrounding the terminal portions 913H, 913B, 913C, and 913E.

The terminal portion 913E is identical to that described in the first and second variations, and a description of this portion will not be repeated. Further, the terminal portion 913H is movable in the second direction similar to the terminal portions 913B and 913C. The terminal portion 913H contacts the electrical contact surface 611A of the chip 61. The support portion 920 is identical to that described in the third variation, and a description of this portion will not be repeated.

The support portion 921 protrudes in the second direction from the surface region of the first guide plate 4911. The support portion 921 has a semispherical shape. The support portion 921 has a height in the second direction with respect to the surface region of the first guide plate 4911 equivalent to a height of the terminal portion 913E and a height of the support portion 920 in the second direction with respect to the surface region of the first guide plate 4911. Further, the support portion 920 is disposed at a position different from the terminal portion 913E and the support portion 921 in the third direction. The support portion 921 is disposed at substantially the same position as the terminal portion 913E in the third direction. The surface of the chip 61 at which the electrical contact surfaces 611A-611D are positioned contacts the support portion 921. Hence, the chip 61 is supported at three points by the support portions 920 and 921 and the terminal portion 913E. Thus, the orientation of the chip 61 is stable, thereby easily maintaining a state of contact between the terminal portion 913H and the electrical contact surface 611A, a state of contact between the terminal portion 913B and the electrical contact surface 611B, a state of contact between the terminal portion 913C and the electrical contact surface 611C, and a state of contact between the terminal portion 913E and the electrical contact surface 611D.

Note that the support portions 920 and 921 may be formed integrally with the first guide plate 4911 or may be formed as separate members from the first guide plate 4911. Further, the support portion 921 may be disposed at substantially the same position as the support portion 920 in the third direction or at different positions in the third direction from both the support portion 920 and the terminal portion 913E.

As an alternative, the terminal portion 913H may not be movable in the second direction while the terminal portion 913E may be movable in the second direction. In this case, the support portion 921 is disposed at a position closer to the terminal portion 913E of the first guide plate 4911 than to the terminal portion 913H of the first guide plate 4911 in the first direction.

7.5. Fifth Variation

A first guide plate 5911 according to a fifth variation of the embodiment will be described with reference to FIG. 15, wherein like parts and components are designated by the same reference numerals as those of the above-described embodiment and variations to avoid duplicating description.

Figure 15:
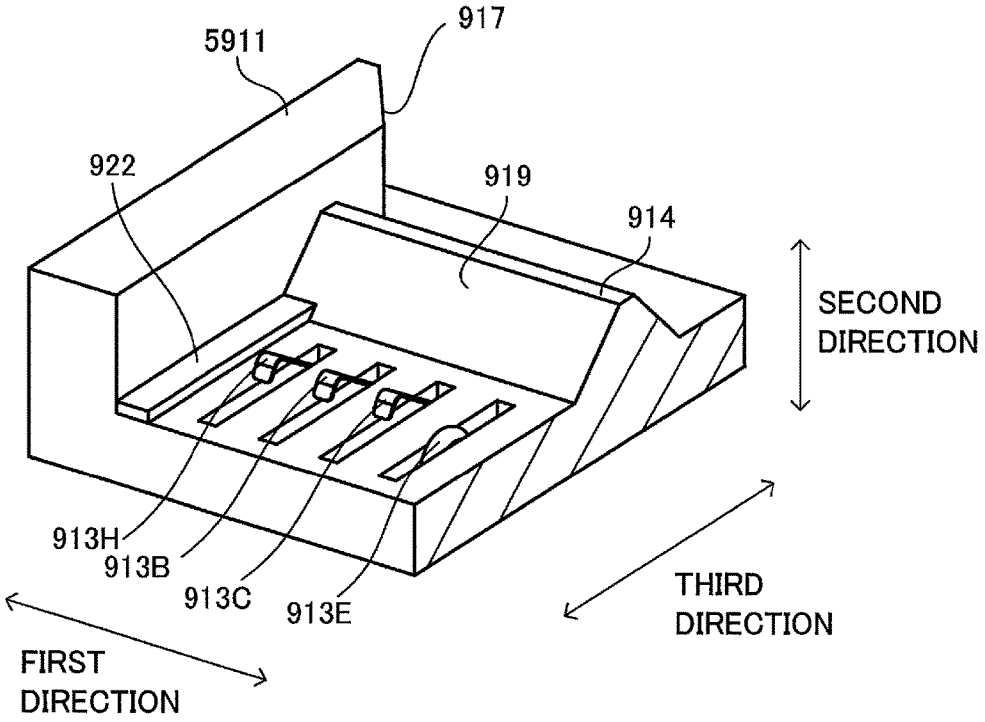
FIG. 15 is a perspective view of a first guide plate according to a fifth variation of the embodiment.

FIG. 15 is a perspective view of the first guide plate 5911 according to the fifth variation. Note that a portion of the first guide plate 5911 where the fourth guide surface 918 (see FIG. 6) is positioned has been omitted from FIG. 15.

The first guide plate 5911 has the terminal portion 913E in place of the terminal portion 913D of the embodiment. The terminal portion 913E has a different shape from the terminal portion 913D, as described above. Further, the first guide plate 5911 has the terminal portion 913H in place of the terminal portion 913A of the embodiment. While the terminal portion 913A is immovable in the second direction, the terminal portion 913H is movable in the second direction. Further, the first guide plate 5911 has a support portion 922. The support portion 922 is positioned at a surface region of the first guide plate 5911 surrounding the terminal portions 913H, 913B, 913C, and 913E.

The terminal portion 913E is identical to that described in the first and second variations, and the terminal portion 913H is identical to that described in the fourth variation. Hence, a description of these portions will not be repeated.

The support portion 922 is positioned at the surface region of the first guide plate 5911. The support portion 922 has a rectangular parallelepiped shape that is elongated in the third direction. The support portion 922 has a height in the second direction with respect to the surface region of the first guide plate 5911 equivalent to a height of the terminal portion 913E in the second direction with respect to the surface region of the first guide plate 5911. The surface of the chip 61 at which the electrical contact surfaces 611A-611D are positioned contacts the support portion 922. The chip 61 is supported by the support portion 922 and the terminal portion 913E. Since the chip 61 comes into line contact with the support portion 922 and comes into point contact with the terminal portion 913E, the orientation of the chip 61 is stable, thereby easily maintaining a state of contact between the terminal portion 913H and the electrical contact surface 611A, a state of contact between the terminal portion 913B and the electrical contact surface 611B, a state of contact between the terminal portion 913C and the electrical contact surface 611C, and a state of contact between the terminal portion 913E and the electrical contact surface 611D.

7.6. Sixth Variation

A first guide plate 6911 according to a sixth variation of the embodiment will be described with reference to FIG. 16, wherein like parts and components are designated by the same reference numerals as those of the above-described embodiment and variations to avoid duplicating description.

Figure 16:
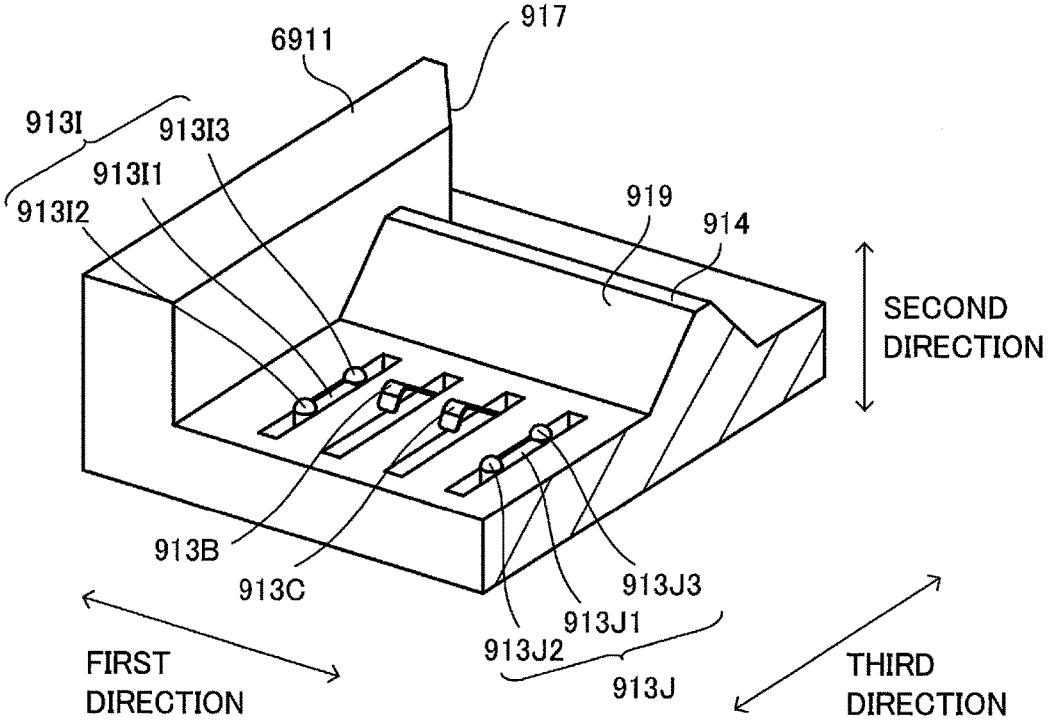
FIG. 16 is a perspective view of a first guide plate according to a sixth variation of the embodiment.

FIG. 16 is a perspective view of the first guide plate 6911 according to the sixth variation. Note that a portion of the first guide plate 6911 where the fourth guide surface 918 (see FIG. 6) is positioned has been omitted from FIG. 16.

The first guide plate 6911 has a terminal portion 913I in place of the terminal portion 913A of the embodiment. The terminal portion 913I has a different shape from the terminal portion 913A. Further, the first guide plate 6911 has a terminal portion 913J in place of the terminal portion 913D of the embodiment. The terminal portion 913J has a different shape from the terminal portion 913D.

The terminal portion 913I has a linear portion 913I1, a first protruding portion 913I2, and a second protruding portion 913I3. The linear portion 913I1 extends in the third direction along a surface region of the first guide plate 6911 surrounding the terminal portions 913I, 913B, 913C, and 913J. The linear portion 913I1 is arranged parallel to the electrical contact surface 611A of the chip 61. The first protruding portion 913I2 is positioned at one end of the linear portion 913I1. The second protruding portion 913I3 is positioned at the other end of the linear portion 913I1. The first protruding portion 913I2 and the second protruding portion 913I3 protrude farther in the second direction toward the second guide plate 912 than a center region of the linear portion 913I1. The first protruding portion 913I2 and the second protruding portion 913I3 come into contact with the electrical contact surface 611A.

The terminal portion 913J has a linear portion 913J1, a first protruding portion 913J2, and a second protruding portion 913J3. The linear portion 913J1 extends in the third direction along the surface region of the first guide plate 6911. The linear portion 913J1 is arranged parallel to the electrical contact surface 611D of the chip 61. The first protruding portion 913J2 is positioned at one end of the linear portion 913J1. The second protruding portion 913J3 is positioned at the other end of the linear portion 913J1. The first protruding portion 913J2 and the second protruding portion 913J3 protrude farther in the second direction toward the second guide plate 912 than a center region of the linear portion 913J1. The first protruding portion 913J2 and the second protruding portion 913J3 come into contact with the electrical contact surface 611D.

With this configuration, an area of contact between the electrical contact surface 611A and the protruding portions 913I2 and 913I3 is small. Further, an area of contact between the electrical contact surface 611D and the protruding portions 913J2 and 913J3 is small. Thus, when the chip 61 is in contact with the first guide plate 6911, a pressing force per unit area that the chip 61 applies to the first guide plate 6911 is greater, thereby improving reliability of electrical conductive connections between the terminal portions 913I, 913B, 913C, and 913J and the electrical contact surfaces 611A-611D.

Note that it is sufficient for the electrical contact surface 611A to contact at least one of the first protruding portion 913I2 and the second protruding portion 913I3. Similarly, it is sufficient for the electrical contact surface 611D to contact at least one of the first protruding portion 913J2 and the second protruding portion 913J3. With this configuration, even if the chip 61 is displaced in the third direction, for example, the electrical contact surface 611A can contact at least one of the first protruding portion 913I2 and the second protruding portion 913I3, and the electrical contact surface 611D can contact at least one of the first protruding portion 913J2 and the second protruding portion 913J3.

While the embodiment and its variations are described above, the various elements introduced in the embodiment and the variations may be suitably combined with one another, provided that there are no inconsistencies.

Incidentally, the terminal portions fixed to the first guide plate so as to be immovable relative to the first guide plate need not be completely fixed thereto. Each terminal portion may be movable relative to the first guide plate without departing from the scope of the embodiment and variations. For example, the height of the terminal portions 913A and 913D in the second direction in FIG. 6 may be lower than the terminal portions 913B and 913C so as to reduce a range in which the terminal portions 913B and 913C is movable in the second direction.

Further, the terminal portions are provided at the drawer unit 90 in the embodiment and variations thereof. However, the terminal portions may not be provided at the drawer unit 90. For example, the terminal portions may be provided at the body of the image forming apparatus 100 at a position other than the drawer unit 90. Further, the terminal portions may be provided at an image forming apparatus that does not include a drawer unit 90. In this case, the developing cartridge 1 may be integrally configured with the photosensitive drum 92 and may be mounted in a slot formed in the image forming apparatus. Hence, terminal portions are positioned for contacting the chip 61 when the developing cartridge 1 is mounted in the image forming apparatus.

What is claimed is:

1. An image forming apparatus comprising:

a frame;

a plate including a first electrical contact portion and a second electrical contact portion, at least a portion of the first electrical contact portion being movable relative to the plate, the at least a portion of the first electrical contact portion being separated farther from the plate than the second electrical contact portion is from the plate; and a developing cartridge detachably mountable to the frame, the developing cartridge comprising:

a storage medium including a first electrical contact surface and a second electrical contact surface; and a pressing portion configured to press the first electrical contact surface toward the first electrical contact portion to bring the first electrical contact surface into contact with the first electrical contact portion and to press the second electrical contact surface toward the second electrical contact portion to bring the second electrical contact surface into contact with the second electrical contact portion in a state where the developing cartridge is mounted to the frame.

2. The image forming apparatus according to claim 1, wherein at least a portion of the second electrical contact portion is movable relative to the plate.

3. The image forming apparatus according to claim 1, wherein the second electrical contact portion is fixed to the plate.

4. The image forming apparatus according to claim 1, wherein the at least a portion of the first electrical contact portion is configured to expand and contract relative to the plate.

5. The image forming apparatus according to claim 1, wherein the storage medium includes a third electrical contact surface, wherein the plate includes a third electrical contact portion, wherein the at least a portion of the first electrical contact portion is separated farther from the plate than the second electrical contact portion and the third electrical contact portion are from the plate, wherein the first electrical contact portion is positioned between the second electrical contact portion and the third electrical contact portion, and wherein the pressing portion is configured to press the third electrical contact surface toward the third electrical contact portion to bring the third electrical contact surface into contact with the third electrical contact portion in a state where the developing cartridge is mounted to the frame.

6. The image forming apparatus according to claim 1, wherein, in a state where the developing cartridge is mounted to the frame, the pressing portion is configured to press the first electrical contact surface and the second electrical contact surface in a pressing direction crossing the first electrical contact surface and the second electrical contact surface, wherein the second electrical contact portion includes a linear portion parallel to the second electrical contact surface, wherein the plate is configured to support the linear portion at a position opposite the first electrical contact surface and the second electrical contact surface with respect to the linear portion in the pressing direction, and wherein the second electrical contact surface is configured to contact the linear portion of the second electrical contact portion.

7. The image forming apparatus according to claim 1, wherein, in a state where the developing cartridge is mounted to the frame, the pressing portion is configured to press the first electrical contact surface and the second electrical contact surface in a pressing direction crossing the first electrical contact surface and the second electrical contact surface, wherein the second electrical contact portion includes:

a linear portion parallel to the second electrical contact surface;

a first protruding portion positioned at one end of the linear portion, the first protruding portion protruding farther in the pressing direction toward the second electrical contact surface than a center region of the linear portion; and a second protruding portion positioned at the other end of the linear portion, the second protruding portion protruding farther in the pressing direction toward the second electrical contact surface than the center region of the linear portion, wherein the plate is configured to support the linear portion at a position opposite the first electrical contact surface and the second electrical contact surface with respect to the linear portion in the pressing direction, and wherein the second electrical contact surface is configured to contact the first protruding portion and the second protruding portion of the second electrical contact portion.

8. The image forming apparatus according to claim 1, wherein the first electrical contact portion is grounded.

9. The image forming apparatus according to claim 1, wherein the plate includes a support portion supporting the storage medium in a state where the developing cartridge is mounted to the frame.

* * * * *